US008413710B2

(12) United States Patent
Jacques et al.

(10) Patent No.: US 8,413,710 B2
(45) Date of Patent: Apr. 9, 2013

(54) CONTINUOUS CASTING SEALING METHOD

(75) Inventors: Michael P. Jacques, Canton, OH (US); Kuang-O Yu, Highland Heights, OH (US)

(73) Assignee: RTI International Metals, Inc., Niles, OH (US)

( * ) Notice: Subject to any disclaimer, the term of this patent is extended or adjusted under 35 U.S.C. 154(b) by 0 days.

(21) Appl. No.: 13/451,689

(22) Filed: Apr. 20, 2012

(65) Prior Publication Data

US 2012/0199307 A1 Aug. 9, 2012

Related U.S. Application Data

(60) Division of application No. 12/828,782, filed on Jul. 1, 2010, now Pat. No. 8,196,641, which is a continuation-in-part of application No. 12/283,226, filed on Sep. 10, 2008, now Pat. No. 7,926,548, which is a continuation-in-part of application No. 11/799,574, filed on May 2, 2007, now Pat. No. 7,484,549, which is a continuation-in-part of application No. 11/433,107, filed on May 12, 2006, now Pat. No. 7,484,548, which is a continuation-in-part of application No. 10/989,563, filed on Nov. 16, 2004, now Pat. No. 7,322,397.

(51) Int. Cl.
*B22D 11/00* (2006.01)

(52) U.S. Cl.
USPC ..... 164/415

(58) Field of Classification Search ..... 164/415, 164/417, 425, 439, 445, 475
See application file for complete search history.

(56) References Cited

U.S. PATENT DOCUMENTS

| | | | | |
|---|---|---|---|---|
| 2,238,155 | A | 4/1941 | Cohen | |
| 2,709,842 | A | 6/1955 | Findlay | |
| 2,858,586 | A | 11/1958 | Brennan | |
| 2,858,588 | A | 11/1958 | Hoffman | |
| 2,903,759 | A | 9/1959 | Brennan | |
| 3,396,778 | A | 8/1968 | Jensen et al. | |
| 3,470,939 | A | 10/1969 | Coad | |
| 3,561,399 | A | 2/1971 | Federman | |
| 3,888,300 | A | 6/1975 | Guichard et al. | |
| 4,024,309 | A | 5/1977 | Pender | |
| 4,391,319 | A | 7/1983 | Heaslip et al. | |
| 4,533,243 | A | 8/1985 | Zhukov et al. | |
| 6,868,896 | B2 | 3/2005 | Jackson et al. | |
| 7,322,397 | B2 | 1/2008 | Jacques et al. | |
| 8,069,903 | B2 * | 12/2011 | Jacques et al. | 164/415 |
| 8,141,617 | B2 * | 3/2012 | Jacques et al. | 164/475 |
| 8,196,641 | B2 * | 6/2012 | Jacques et al. | 164/415 |
| 2004/0250980 | A1 | 12/2004 | Nakayama et al. | |
| 2006/0254746 | A1 | 11/2006 | Jacques et al. | |
| 2007/0204970 | A1 | 9/2007 | Jacques et al. | |

* cited by examiner

FOREIGN PATENT DOCUMENTS

| | | |
|---|---|---|
| GB | 1293939 | 10/1972 |
| GB | 1358744 | 7/1974 |
| WO | 03086683 | 10/2003 |

*Primary Examiner* — Kevin P Kerns
(74) *Attorney, Agent, or Firm* — Sand & Sebolt

(57) ABSTRACT

A casting furnace for manufacturing a metal casting comprises an interior chamber and a secondary chamber through which the metal casting passes from the interior chamber into external atmosphere. A seal along the secondary chamber surrounds and seals against the metal casting to separate the interior chamber from the external atmosphere in a manner which allows for an extended period of continuous casting. A force producing mechanism typically forces the seal against the metal casting. Multiple seals may be used sequentially to increase the duration of the sealing capability and the continuous casting process.

18 Claims, 30 Drawing Sheets

CONTINUOUS CASTING SEALING METHOD

CROSS REFERENCE TO RELATED APPLICATIONS

This application is a divisional of U.S. patent application Ser. No. 12/828,782, filed Jul. 1, 2010, (now U.S. Pat. No. 8,196,641), which is a continuation-in-part of U.S. patent application Ser. No. 12/283,226, filed Sep. 10, 2008 (now U.S. Pat. No. 7,926,548), which is a continuation-in-part of U.S. patent application Ser. No. 11/799,574, filed May 2, 2007 (now U.S. Pat. No. 7,484,549), which is a continuation-in-part of U.S. patent application Ser. No. 11/433,107, filed May 12, 2006 (now U.S. Pat. No. 7,484,548), which is a continuation-in-part of U.S. patent application Ser. No. 10/989,563, filed Nov. 16, 2004 (now U.S. Pat. No. 7,322, 397); the disclosures of which are incorporated herein by reference.

BACKGROUND OF THE INVENTION

1. Technical Field

The invention relates generally to the continuous casting of metals. More particularly, the invention relates to the protection of reactionary metals from reacting with the atmosphere when molten or at elevated temperatures. Specifically, the invention relates to pressurized seals which prevent the atmosphere from contacting a metal casting as it exits the melting chamber.

2. Background Information

Hearth melting processes, Electron Beam Cold Hearth Refining (EBCHR) and Plasma Arc Cold Hearth Refining (PACHR), were originally developed to improve the quality of titanium alloys used for jet engine rotating components. Quality improvements in the field are primarily related to the removal of detrimental particles such as high density inclusions (HDI) and hard alpha particles. Recent applications for both EBCHR and PACHR are more focused on cost reduction considerations. Some ways to effect cost reduction are increasing the flexible use of various forms of input materials, creating a single-step melting process (conventional melting of titanium, for instance, requires two or three melting steps) and facilitating higher product yield.

Titanium and other metals are highly reactive and therefore must be melted in a vacuum or in an inert atmosphere. In electron beam cold hearth refining (EBCHR), a high vacuum is maintained in the furnace melting and casting chambers in order to allow the electron beam guns to operate. In plasma arc cold hearth refining (PACHR), the plasma arc torches use an inert gas such as helium or argon (typically helium) to produce plasma and therefore the atmosphere in the furnace consists primarily of a partial or positive pressure of the gas used by the plasma torches. In either case, contamination of the furnace chamber with oxygen or nitrogen, which react with molten titanium, may cause hard alpha defects in the cast titanium. Thus, oxygen and nitrogen should be completely or substantially avoided within the furnace chamber throughout the casting process.

In order to permit extraction of the cast from the furnace with minimal interruption to the casting process and no contamination of the melting chamber with oxygen and nitrogen or other gases, current furnaces utilize a withdrawal chamber. During the casting process the lengthening cast moves out of the bottom of the mold through an isolation gate valve and into the withdrawal chamber. When the desired or maximum cast length is reached it is completely withdrawn out of the mold through the gate valve and into the withdrawal chamber.

Then, the gate valve is closed to isolate the withdrawal chamber from the furnace melt chamber, the withdrawal chamber is moved from under the furnace and the cast is removed.

Although functional, such furnaces have several limitations. First, the maximum cast length is limited to the length of the withdrawal chamber. In addition, casting must be stopped during the process of removing a cast from the furnace. Thus, such furnaces allow continuous melting operations but do not allow continuous casting. Furthermore, the top of the cast will normally contain shrinkage cavities (pipe) that form when the cast cools. Controlled cooling of the cast top, known as a "hot top", can reduce these cavities, but the hot top is a time-consuming process which reduces productivity. The top portion of the cast containing shrinkage or pipe cavities is unusable material which thus leads to a yield loss. Moreover, there is an additional yield loss due to the dovetail at the bottom of the cast that attaches to the withdrawal ram.

The present invention eliminates or substantially reduces these problems with a sealing apparatus which permits continuous casting of the titanium, superalloys, refractory metals, and other reactive metals whereby the cast in the form of an ingot, bar, slab or the like can move from the interior of a continuous casting furnace to the exterior without allowing the introduction of air or other external atmosphere into the furnace chamber.

BRIEF SUMMARY OF THE INVENTION

The present invention provides a casting furnace comprising: an interior chamber; a chamber housing which is below the interior chamber and defines a secondary chamber which communicates with the interior chamber and atmosphere external to the interior chamber; a metal casting pathway which extends from the interior chamber through the secondary chamber and is adapted to allow a metal casting to pass there through to the external atmosphere; a compressible first seal which is within the secondary chamber and surrounds the pathway whereby the first seal is adapted to surround the metal casting; and an inner perimeter of the first seal which decreases in response to vertical compression of the secondary chamber.

The present invention also provides a casting furnace comprising: an interior chamber; a chamber housing which defines a secondary chamber which communicates with the interior chamber and atmosphere external to the interior chamber; a metal casting pathway which extends from the interior chamber through the secondary chamber and is adapted to allow a metal casting to pass there through to the external atmosphere; a backing member of the chamber housing which comprises a first annular sidewall having an inner perimeter which partially defines the secondary chamber, and an annular member which extends radially inwardly from the inner perimeter and partially defines the secondary chamber; a ring of the chamber housing which is spaced from the annular member, partially defines the secondary chamber and is slidably received within the inner perimeter of the first annular sidewall; and a compressible seal which is within the secondary chamber and surrounds the pathway whereby the seal is adapted to surround the metal casting; wherein the seal is compressed and moves toward the pathway in response to movement of one of the backing member and ring relative to the other of the backing member and ring whereby the seal is adapted to be forced against an outer periphery of the metal casting in response to the movement as the metal casting is passing through the secondary chamber via the pathway.

The present invention further provides a method comprising the steps of: forming an ingot in an interior chamber defined by a sidewall; directing the ingot from the interior chamber into a secondary chamber; and moving a backing member relative to the sidewall against a first compressible seal to force the first seal against the ingot along the secondary chamber.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DESCRIPTION OF THE PREFERRED EMBODIMENTS

Figure 1:
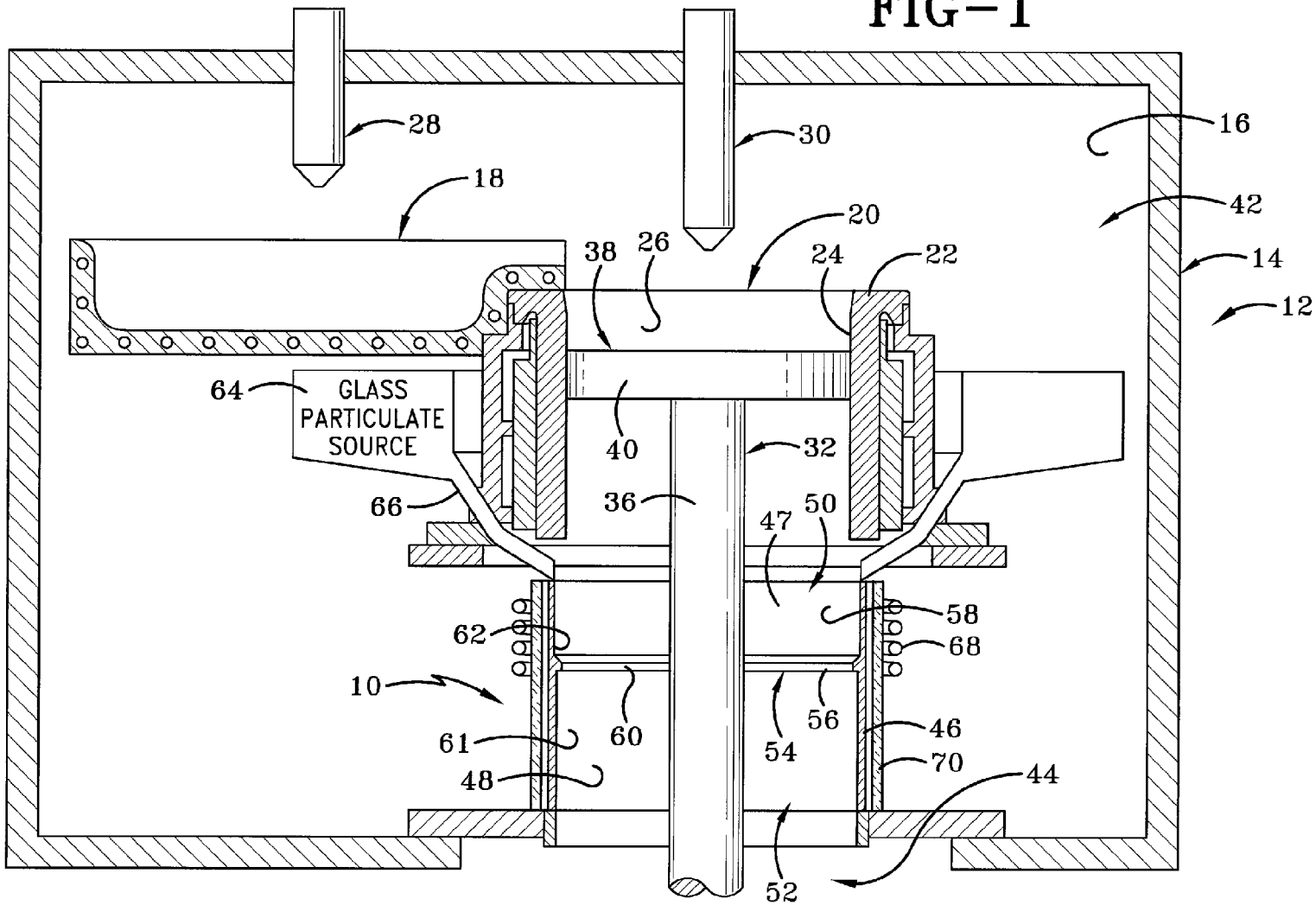
FIG. 1 is a sectional view of the seal of the present invention in use with a continuous casting furnace.

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of the ordinary skill in the art to which this invention belongs. Although any methods, devices or materials similar or equivalent to those described herein can be used in the practice or testing of the invention, the preferred methods, devices, and materials are now described.

The seal of the present invention is indicated generally at 10 in FIGS. 1-5 in use with a continuous casting furnace 12. Furnace 12 includes a chamber wall 14 which encloses a melting chamber 16 within which seal 10 is disposed. Within melting chamber 16, furnace 12 further includes a melting/ refining hearth 18 in fluid communication with a mold 20 having a substantially cylindrical sidewall 22 with a substantially cylindrical inner surface 24 defining a mold cavity 26 therewithin. Heat sources 28 and 30 are disposed respectively above melting/refining hearth 18 and mold 20 for heating and melting reactionary metals such as titanium and superalloys. Heat sources 28 and 30 are preferably plasma torches although other suitable heat sources such as induction and resistance heaters may be used.

Figure 2:
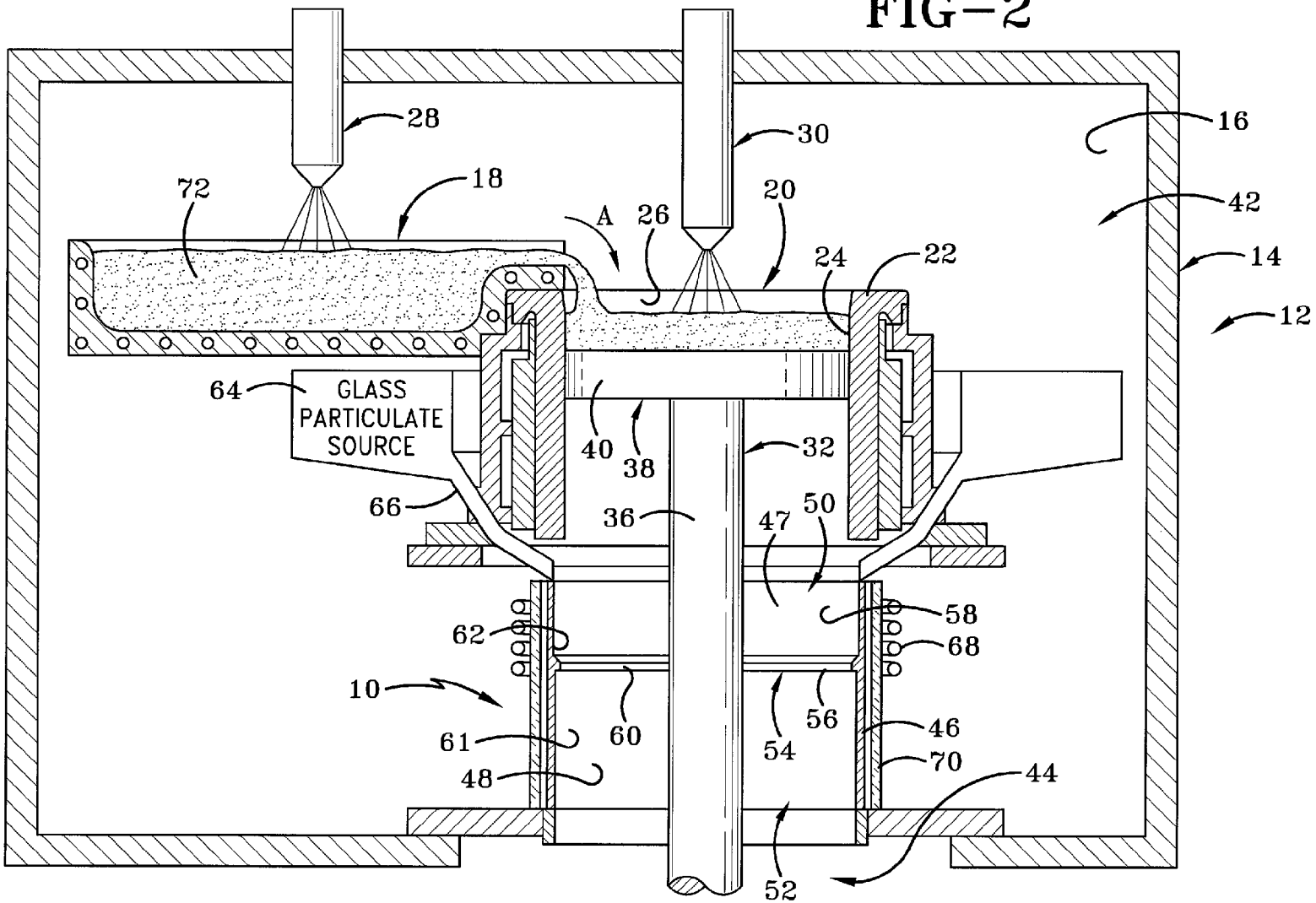
FIG. 2 is similar to FIG. 1 and shows an initial stage of forming an ingot with molten material flowing from the melting/refining hearth into the mold and being heated by heat sources over each of the hearth and mold.
Figure 3:
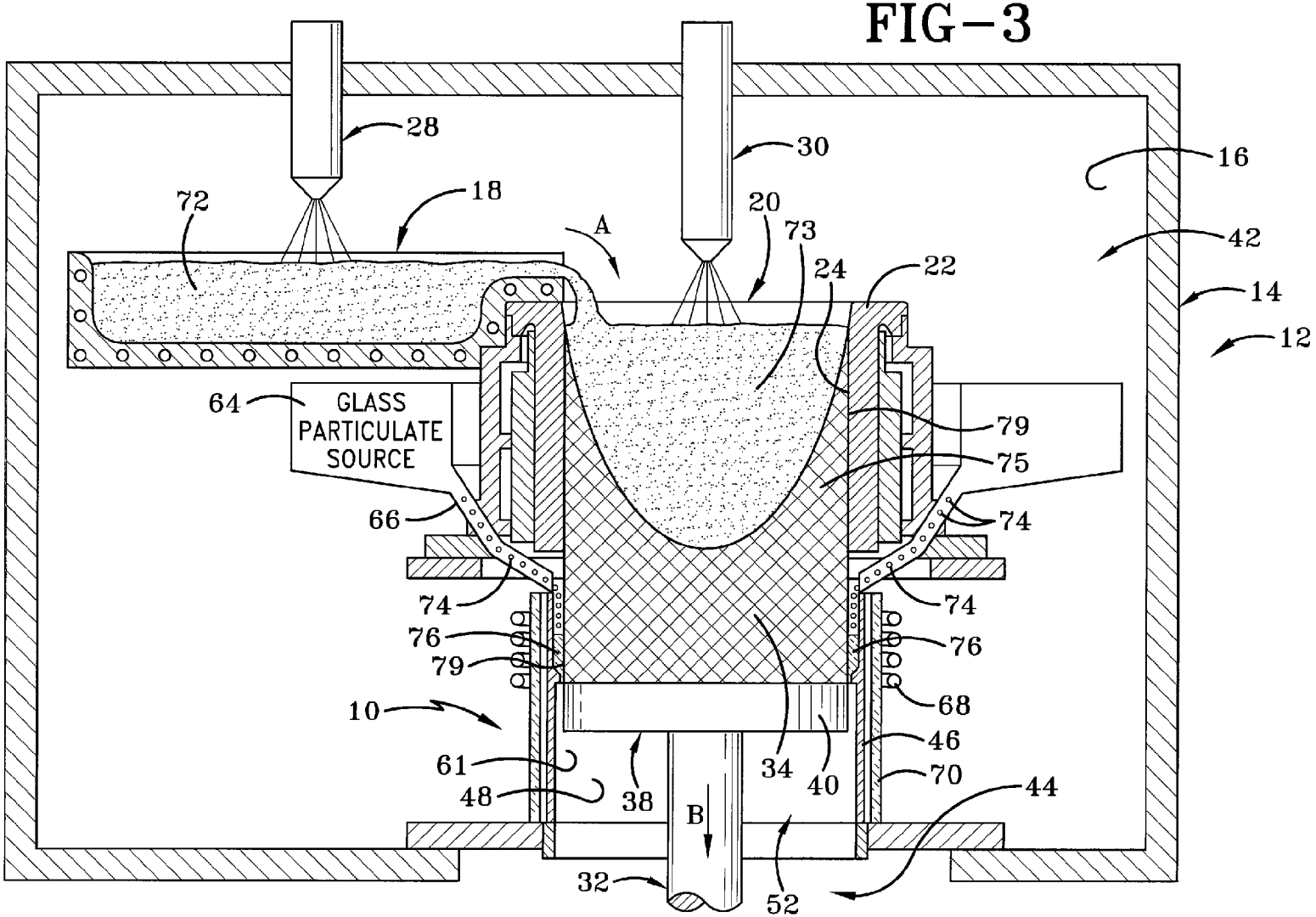
FIG. 3 is similar to FIG. 2 and shows a further stage of formation of the ingot as the ingot is lowered on a lift and into the seal area.
Figure 4:
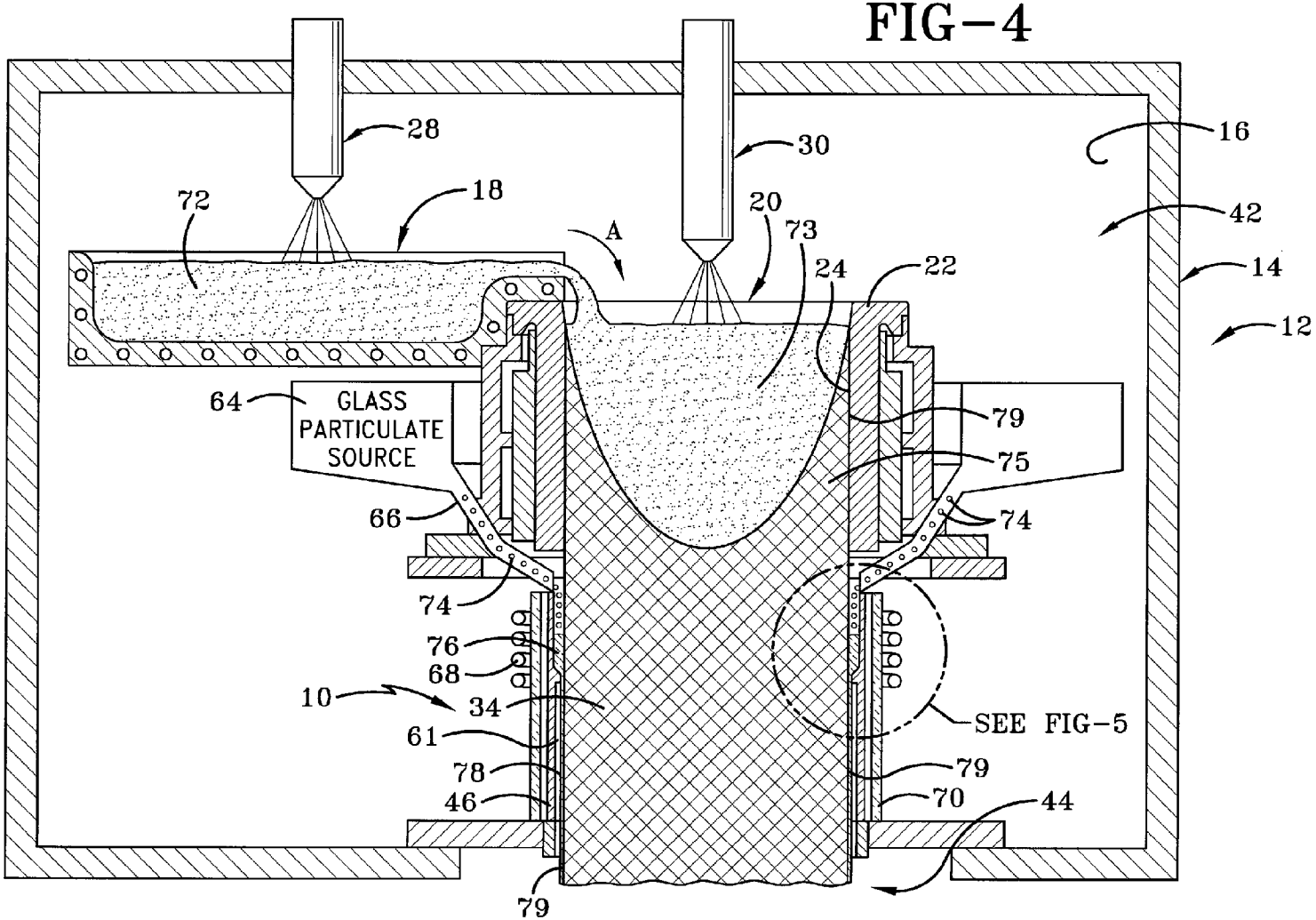
FIG. 4 is similar to FIG. 3 and shows a further stage of formation of the ingot and formation of the glass coating on the ingot.

Furnace 12 further includes a lift or withdrawal ram 32 for lowering a metal cast 34 (FIGS. 2-4). Any suitable withdrawal device may be used. Metal cast 34 may be in any suitable form, such as a round ingot, rectangular slab or the like. Ram 32 includes an elongated arm 36 with a mold support 38 in the form of a substantially cylindrical plate seated atop of arm 36. Mold support 38 has a substantially cylindrical outer surface 40 which is disposed closely adjacent inner surface 24 of mold 20 as ram 32 moves in a vertical direction. During operation, melting chamber 16 contains an atmosphere 42 which is non-reactive with reactive metals such as titanium and superalloys which may be melted in furnace 12. Inert gases may be used to form non-reactive atmosphere 42, particularly when using plasma torches, with which helium or argon are often used, most typically the former. Outside of chamber wall 14 is an atmosphere 44 which is reactive with the reactionary metals when in a heated state.

Seal 10 is configured to prevent reactive atmosphere 44 from entering melting chamber 16 during the continuous casting of reactionary metals such as titanium and superalloys. Seal 10 is also configured to protect the heated metal cast 34 when it enters reactive atmosphere 44. Seal 10 includes a passage wall or port wall 46 having a substantially cylindrical inner surface 47 defining passage 48 therewithin which has an entrance opening 50 and an exit opening 52. Port wall 46 includes an inwardly extending annular flange 54 having an inner surface or circumference 56. Inner surface 47 of port wall 46 adjacent entrance opening 50 defines an enlarged or wider section 58 of passage 48 while flange 54 creates a narrowed section 60 of passage 48. Below annular flange 54, inner surface 47 of port wall 46 defines an enlarged exit section 61 of passage 48.

As later explained, a reservoir 62 for a molten material such as liquid glass is formed during operation of furnace 12 in enlarged section 58 of passage 48. A source 64 of particulate glass or other suitable meltable material such as fused salt or slags is in communication with a feed mechanism 66 which is in communication with reservoir 62. Seal 10 may also include a heat source 68 which may include an induction coil, a resistance heater or other suitable source of heat. In addition, insulating material 70 may be placed around seal 10 to help maintain the seal temperature.

The operation of furnace 12 and seal 10 is now described with reference to FIGS. 2-5. FIG. 2 shows heat source 28 being operated to melt reactionary metal 72 within melting/refining hearth 18. Molten metal 72 flows as indicated by Arrow A into mold cavity 26 of mold 20 and is initially kept in a molten state by operation of heat source 30.

FIG. 3 shows ram 32 being withdrawn downwardly as indicated by Arrow B as additional molten metal 72 flows from hearth 18 into mold 20. An upper portion 73 of metal 72 is kept molten by heat source 30 while lower portions 75 of metal 72 begins to cool to form the initial portions of cast 34. Water-cooled wall 22 of mold 20 facilitates solidification of metal 72 to form cast 34 as ram 32 is withdrawn downwardly. At about the time that cast 34 enters narrowed section 60 (FIG. 2) of passage 48, particulate glass 74 is fed from source 64 via feed mechanism 66 into reservoir 62. While cast 34 has cooled sufficiently to solidify in part, it is typically sufficiently hot to melt particulate glass 74 to form liquid glass 76 within reservoir 62 which is bounded by an outer surface 79 of cast 34 and inner surface 47 of port wall 46. If needed, heat source 68 may be operated to provide additional heat through port wall 46 to help melt particulate glass 74 to ensure a sufficient source of liquid glass 76 and/or help keep liquid glass in a molten state. Liquid glass 76 fills the space within reservoir 62 and narrowed portion 60 to create a barrier which prevents external reactive atmosphere 44 from entering melting chamber 16 and reacting with molten metal 72. Annular flange 54 bounds the lower end of reservoir 62 and reduces the gap or clearance between outer surface 79 of cast 34 and inner surface 47 of port wall 46. The narrowing of passage 48 by flange 54 allows liquid glass 76 to pool within reservoir 62 (FIG. 2). The pool of liquid glass 76 in reservoir 62 extends around metal cast 34 in contact with outer surface 79 thereof to form an annular pool which is substantially cylindrical within passage 48. The pool of liquid glass 76 thus forms a liquid seal. After formation of this seal, a bottom door (not shown) which had been separating non-reactive atmosphere 42 from reactive atmosphere 44 may be opened to allow withdrawal of cast 34 from chamber 16.

Figure 5:
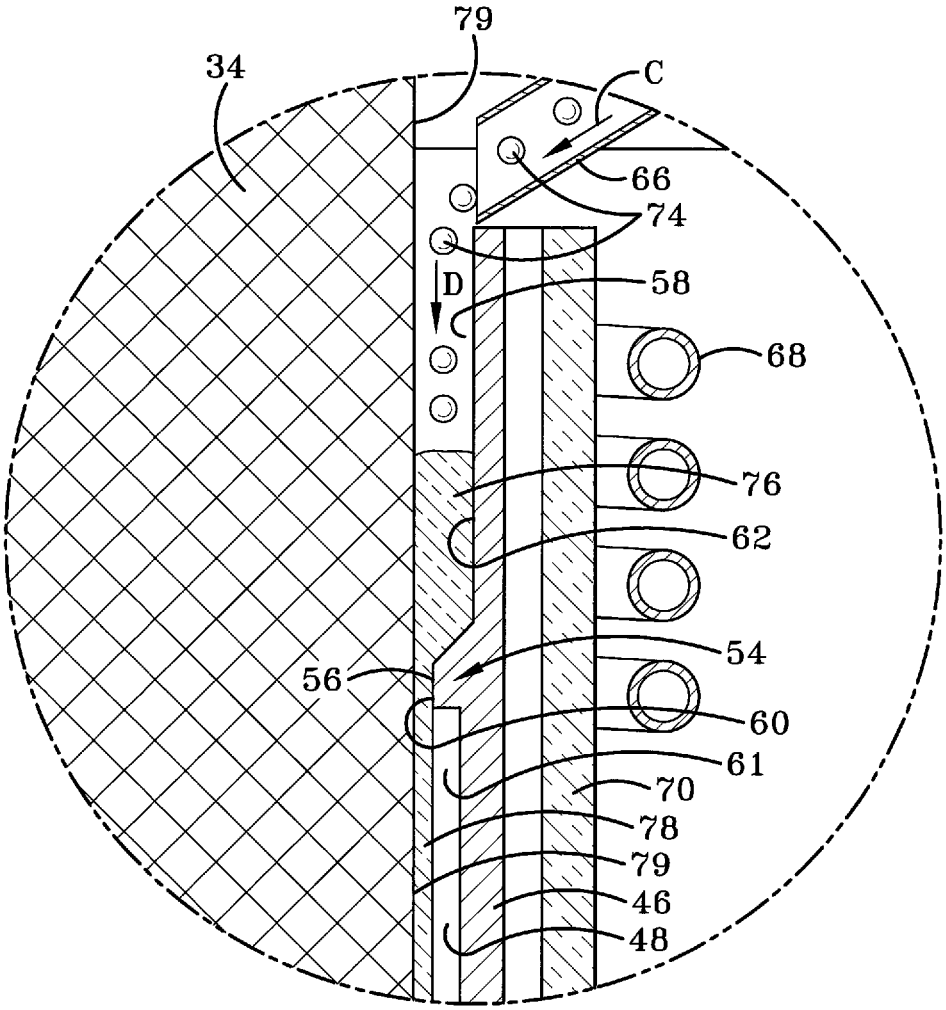
FIG. 5 is an enlarged view of the encircled portion of FIG. 4 and shows particulate glass entering the liquid glass reservoir and the formation of the glass coating.

As cast 34 continues to move downwardly as indicated in FIGS. 4-5, liquid glass 76 coats outer surface 79 of cast 34 as it passes through reservoir 62 and narrowed section 60 of passage 48. Narrowed section 60 reduces the thickness of or thins the layer of liquid glass 76 adjacent outer surface 79 of cast 34 to control the thickness of the layer of glass which exits passage 48 with cast 34. Liquid glass 76 then cools sufficiently to solidify as a solid glass coating 78 on outer surface 79 of cast 34. Glass coating 78 in the liquid and solid states provides a protective barrier to prevent reactive metal 72 forming cast 34 from reacting with reactive atmosphere 44 while cast 34 is still heated to a sufficient temperature to permit such a reaction.

FIG. 5 more clearly shows particulate glass 74 traveling through feed mechanism 66 as indicated by Arrow C and into enlarged section 58 of passage 48 and into reservoir 62 where particulate glass 74 is melted to form liquid glass 76. FIG. 5 also shows the formation of the liquid glass coating in narrowed section 60 of passage 48 as cast 34 moves downwardly. FIG. 5 also shows an open space between glass coating 78 and port wall 46 within enlarged exit section 61 of passage 48 as cast 34 with coating 78 move through section 61.

Figure 7:
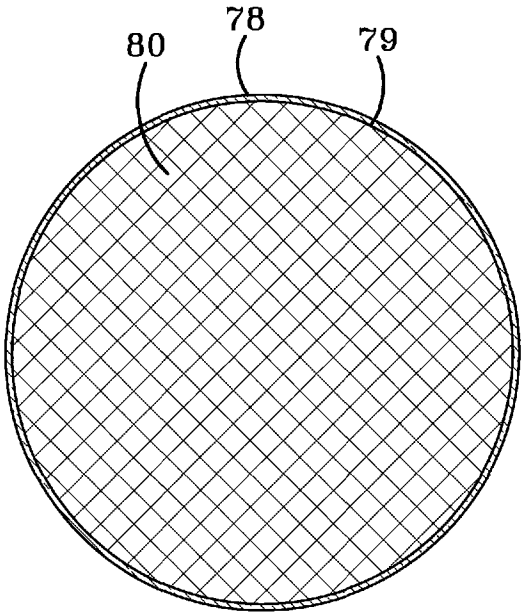
FIG. 7 is a sectional view taken on line 7-7 of FIG. 6.
Figure 6:
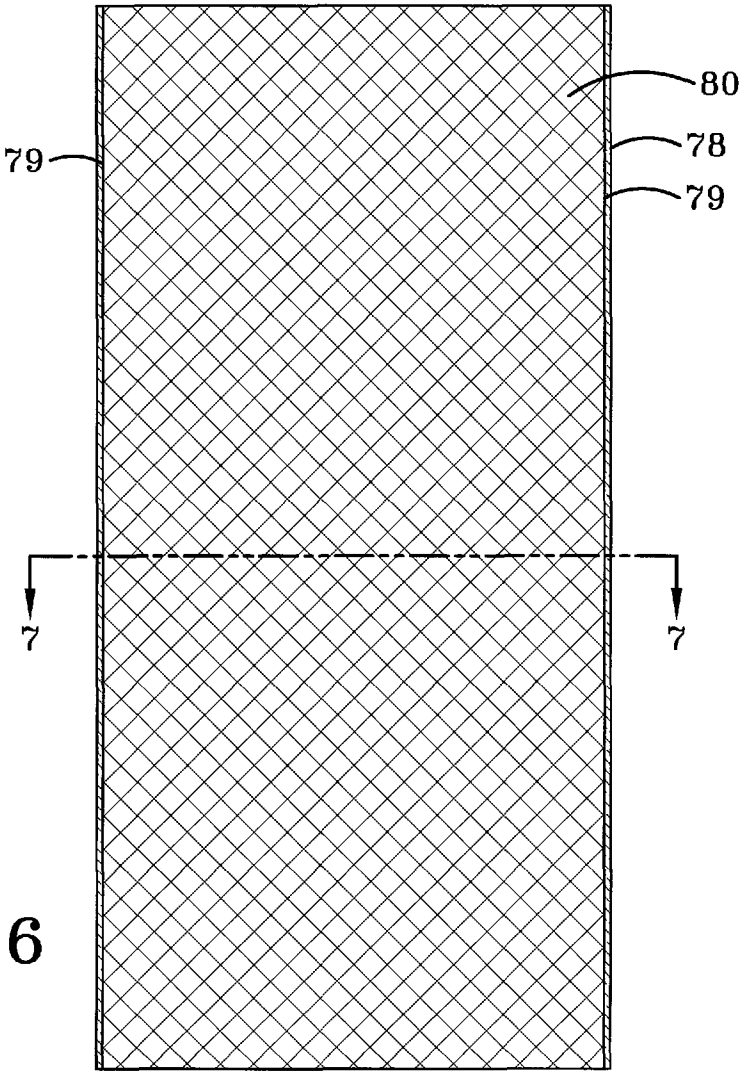
FIG. 6 is a sectional view of the ingot after being removed from the melting chamber of the furnace showing the glass coating on the outer surface of the ingot.

Once cast 34 has exited furnace 12 to a sufficient degree, a portion of cast 34 may be cut off to form an ingot 80 of any desired length, as shown in FIG. 6. As seen in FIGS. 6 and 7, solid glass coating 78 extends along the entire circumference of ingot 80.

Thus, seal 10 provides a mechanism for preventing the entry of reactive atmosphere 44 into melting chamber 16 and also protects cast 34 in the form of an ingot, bar, slab or the like from reactive atmosphere 44 while cast 34 is still heated to a temperature where it is still reactive with atmosphere 44. As previously noted, inner surface 24 of mold 20 is substantially cylindrical in order to produce a substantially cylindrical cast 34. Inner surface 47 of port wall 46 is likewise substantially cylindrical in order to create sufficient space for reservoir 62 and space between cast 34 and inner surface 56 of flange 54 to create the seal and also provide a coating of appropriate thickness on cast 34 as it passes downwardly. Liquid glass 76 is nonetheless able to create a seal with a wide variety of transverse cross-sectional shapes other than cylindrical. The transverse cross-sectional shapes of the inner surface of the mold and the outer surface of the cast are preferably substantially the same as the transverse cross-sectional shape of the inner surface of the port wall, particularly the inner surface of the inwardly extending annular flange in order that the space between the cast and the flange is sufficiently small to allow liquid glass to form in the reservoir and sufficiently enlarged to provide a glass coating thick enough to prevent reaction between the hot cast and the reactive atmosphere outside of the furnace. To form a metal cast suitably sized to move through the passage, the transverse cross-sectional shape of the inner surface of the mold is smaller than that of the inner surface of the port wall.

Additional changes may be made to seal 10 and furnace 12 which are still within the scope of the present invention. For example, furnace 12 may consist of more than a melting chamber such that material 72 is melted in one chamber and transferred to a separate chamber wherein a continuous casting mold is disposed and from which the passage to the external atmosphere is disposed. In addition, passage 48 may be shortened to eliminate or substantially eliminate enlarged exit section 61 thereof. Also, a reservoir for containing the molten glass or other material may be formed externally to passage 48 and be in fluid communication therewith whereby molten material is allowed to flow into a passage similar to passage 48 in order to create the seal to prevent external atmosphere from entering the furnace and to coat the exterior surface of the metal cast as it passes through the passage. In such a case, a feed mechanism would be in communication with this alternate reservoir to allow the solid material to enter the reservoir to be melted therein. Thus, an alternate reservoir may be provided as a melting location for the solid material. However, reservoir 62 of seal 10 is simpler and makes it easier to melt the material using the heat of the metal cast as it passes through the passage.

The seal of the present invention provides increased productivity because a length of the cast can be cut off outside the furnace while the casting process continues uninterrupted. In addition, yield is improved because the portion of each cast that is exposed when cut does not contain shrinkage or pipe cavities and the bottom of the cast does not have a dovetail. In addition, because the furnace is free of a withdrawal chamber, the length of the cast is not limited by such a chamber and thus the cast can have virtually any length that is feasible to produce. Further, by using an appropriate type of glass, the glass coating on the cast may provide lubrication for subsequent extrusion of the cast. Also the glass coating on the cast may provide a barrier when subsequently heating the cast prior to forging to prevent reaction of the cast with oxygen or other atmosphere.

While the preferred embodiment of the seal of the present invention has been described in use with glass particulate matter to form a glass coating, other materials may be used to form the seal and glass coating, such as fused salt or slags for instance.

The present apparatus and process is particularly useful for highly reactive metals such as titanium which is very reactive with atmosphere outside the melting chamber when the reactionary metal is in a molten state. However, the process is suitable for any class of metals, e.g. superalloys, wherein a barrier is needed to keep the external atmosphere out of the melting chamber to prevent exposure of the molten metal to the external atmosphere.

Figure 8:
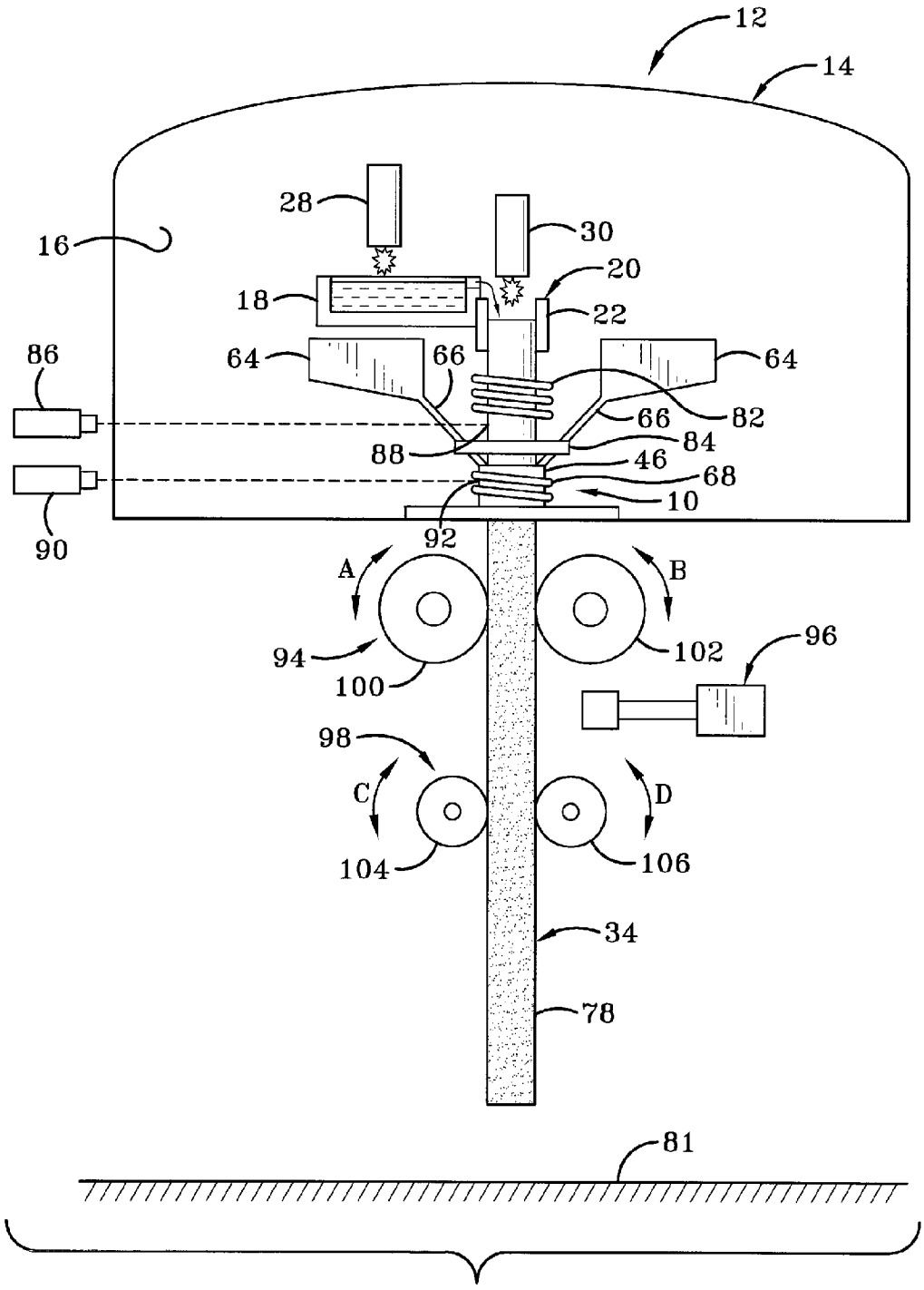
FIG. 8 is a diagrammatic elevational view of the continuous casting furnace of the present invention showing the ingot drive mechanism, the ingot cutting mechanism and the ingot handling mechanism with the newly produced coated metal cast extending downwardly external to the melting chamber and supported by the ingot drive mechanism and ingot handling mechanism.

With reference to FIG. 8, casting furnace 12 is further described. Furnace 12 is shown in an elevated position above a floor 81 of a manufacturing facility or the like. Within interior chamber 16, furnace 12 includes an additional heat source in the form of an induction coil 82 which is disposed below mold 20 and above port wall 46. Induction coil 82 circumscribes the pathway through which metal cast 34 passes during its travel toward the passage within passage wall 46. Thus, during operation, induction coil 82 circumscribes metal cast 34 and is disposed adjacent the outer periphery of the metal cast for controlling the heat of metal cast 34 at a desired temperature for its insertion into the passage in which the molten bath is disposed.

Also within interior chamber 16 is a cooling device in the form of a water cooled tube 84 which is used for cooling conduit 66 of the feed mechanism or dispenser of the particulate material in order to prevent the particulate material from melting within conduit 66. Tube 84 is substantially an annular ring which is spaced outwardly from metal cast 34 and contacts conduit 66 in order to provide for a heat transfer between tube 84 and conduit 66 to provide the cooling described.

Furnace 12 further includes a temperature sensor in the form of an optical pyrometer 86 for sensing the heat of the outer periphery of metal cast 34 at a heat sensing location 88 disposed near induction coil 82 and above port wall 46. Furnace 12 further includes a second optical pyrometer 90 for sensing the temperature at another heat sensing location 92 of port wall 46 whereby pyrometer 90 is capable of estimating the temperature of the molten bath within reservoir 62.

External to and below the bottom wall of chamber wall 14, furnace 12 includes an ingot drive system or lift 94, a cutting mechanism 96 and a removal mechanism 98. Lift 94 is configured to lower, raise or stop movement of metal cast 34 as desired. Lift 94 includes first and second lift rollers 100 and 102 which are laterally spaced from one another and are rotatable in alternate directions as indicated by Arrows A and B to provide the various movements of metal cast 34. Rollers 100 and 102 are thus spaced from one another approximately the same distance as the diameter of the coated metal cast and contact coating 78 during operation. Cutting mechanism 96 is disposed below rollers 100 and 102 and is configured to cut metal cast 34 and coating 78. Cutting mechanism 96 is typically a cutting torch although other suitable cutting mechanisms may be used. Removal mechanism 98 includes first and second removal rollers 104 and 106 which are spaced laterally from one another in a similar fashion as rollers 100 and 102 and likewise engage coating 78 of the coated metal cast as it moves therebetween. Rollers 104 and 106 are rotatable in alternate directions as indicated at Arrows C and D.

Additional aspects of the operation of furnace 12 are described with reference to FIGS. 8-10. Referring to FIG. 8, molten metal is poured into mold 20 as previously described to produce metal cast 34. Cast 34 then moves downwardly along a pathway from mold 20 through the interior space defined by induction coil 82 and into the passage defined by passage wall 46. Induction coils 82 and 68 and pyrometers 86 and 90 are part of a control system for providing optimal conditions to produce the molten bath within reservoir 62 to provide the liquid seal and coating material which ultimately forms protective barrier 78 on metal cast 34. More particularly, pyrometer 86 senses the temperature at location 88 on the outer periphery of metal cast 34 while pyrometer 90 senses the temperature of passage wall 46 at location 92 in order to assess the temperature of the molten bath within reservoir 62. This information is used to control the power to induction coils 82 and 68 to provide the optimal conditions noted above. Thus, if the temperature at location 88 is too low, induction coil 82 is powered to heat metal cast 34 to bring the temperature at location 88 into a desired range. Likewise, if the temperature at location 88 is too high, the power to induction coil 82 is reduced or turned off. Preferably, the temperature at location 88 is maintained within a given temperature range. Likewise, pyrometer 90 assesses the temperature at location 92 to determine whether the molten bath is at a desired temperature. Depending on the temperature at location 92, the power to induction coil 68 may be increased, reduced or turned off altogether to maintain the temperature of the molten bath within a desired temperature range. As the temperature of metal cast 34 and the molten bath is being controlled, water cooled-tube 84 is operated to provide cooling to conduit 66 in order to allow particulate material from source 64 to reach the passage within passage wall 46 in solid form to prevent clogging of conduit 66 due to melting therein.

With continued reference to FIG. 8, the metal cast moves through seal 10 in order to coat metal cast 34 to produce the coated metal cast which moves downwardly into the external atmosphere and between rollers 100 and 102, which engage and lower the coated metal cast downwardly in a controlled manner. The coated metal cast continues downwardly and is engaged by rollers 104 and 106.

Figure 9:
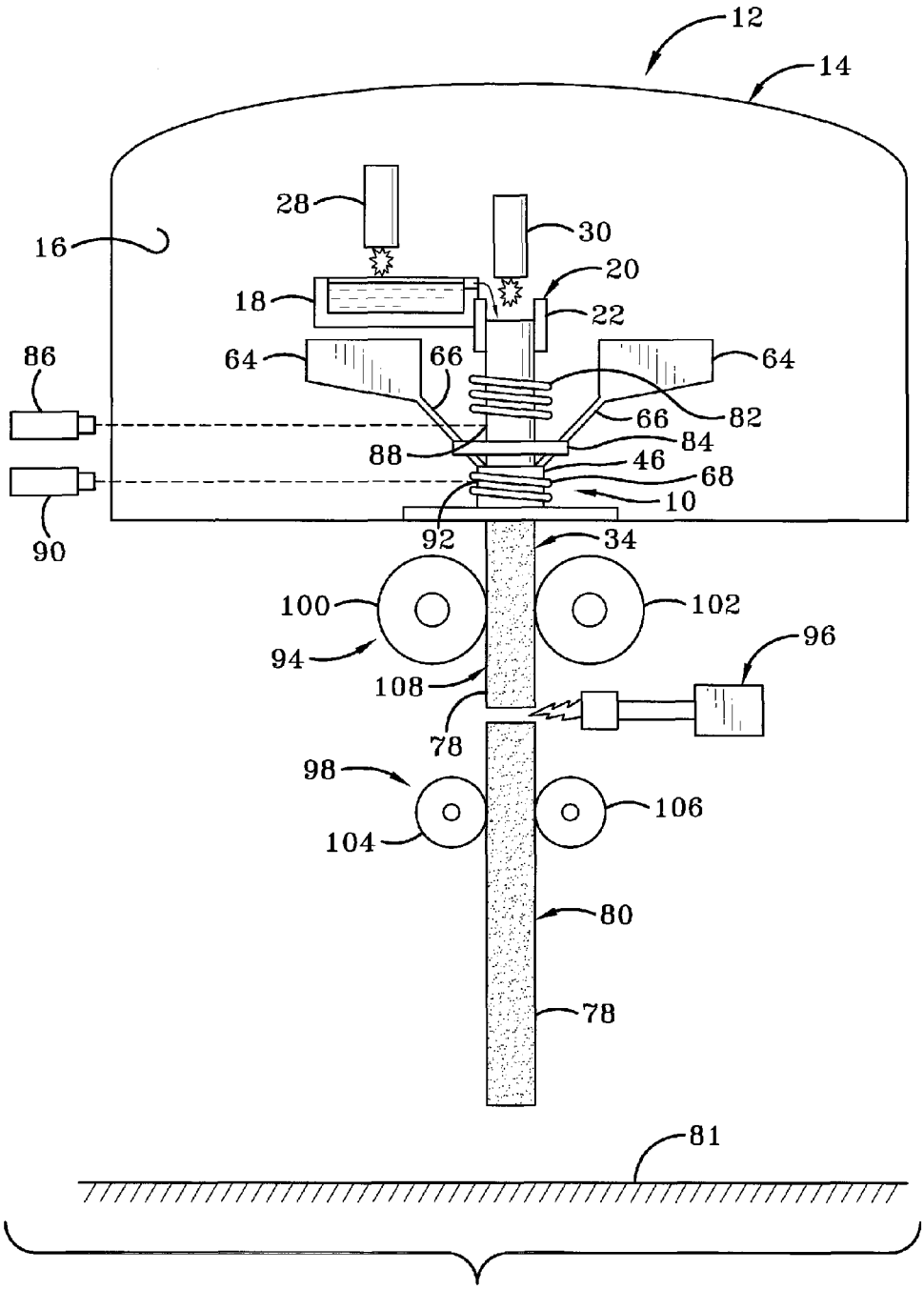
FIG. 9 is similar to FIG. 8 and shows a segment of the coated metal cast having been cut by the cutting mechanism.
Figure 10:
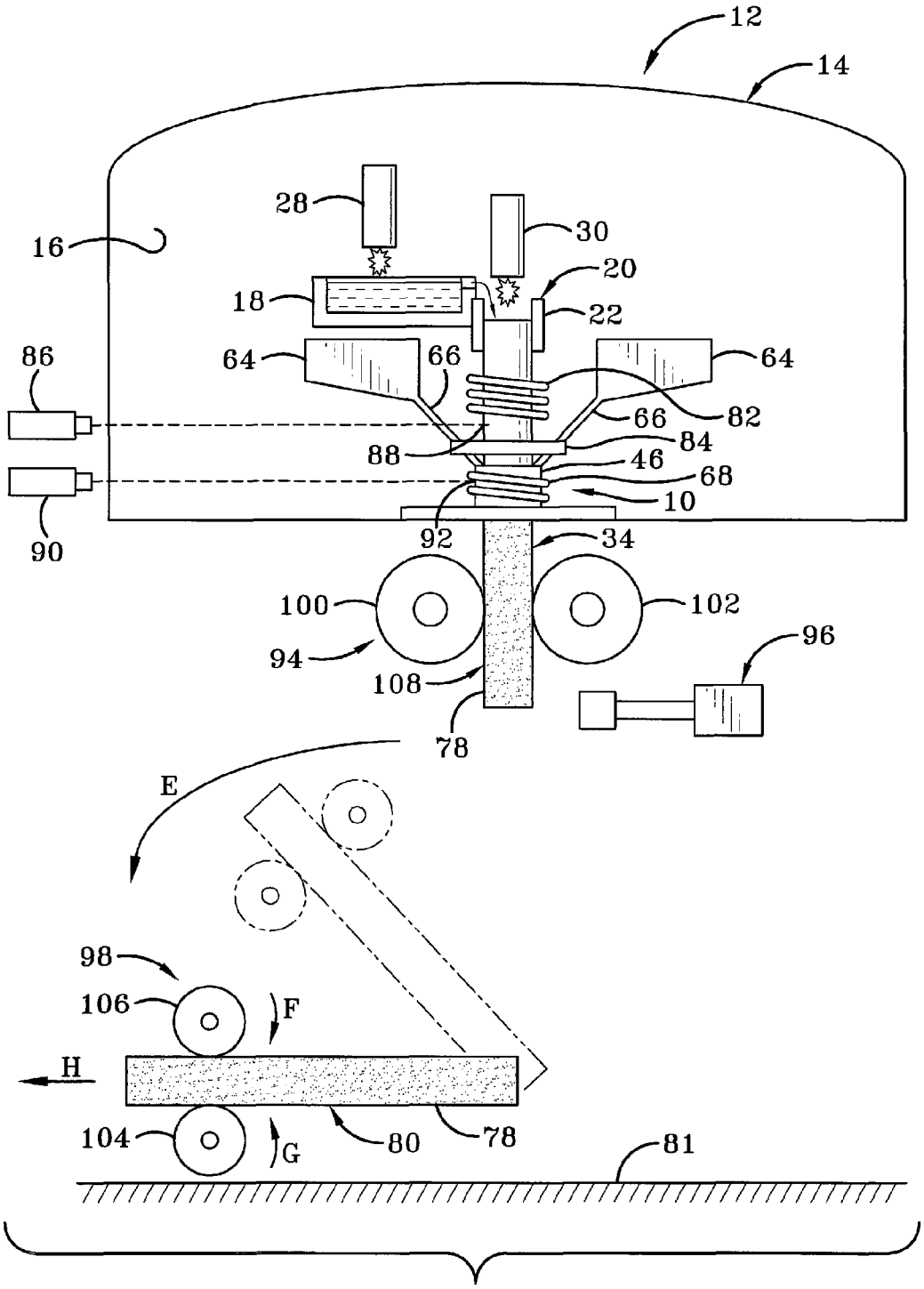
FIG. 10 is similar to FIG. 9 and shows the cut segment having been lowered for convenient handling thereof.

Referring to FIG. 9, cutting mechanism 96 then cuts the coated metal cast to form a cut segment in the form of coated ingot 80. Thus, by the time the coated metal cast reaches the level of cutting mechanism 96, it has cooled to a temperature at which the metal is substantially non-reactive with the external atmosphere. FIG. 9 shows ingot 80 in a cutting position in which ingot 80 has been separated from the parent segment 108 of metal cast 34. Rollers 104 and 106 then rotate as a unit from the receiving or cutting position shown in FIG. 9 downwardly toward floor 81 as indicated by Arrow E in FIG. 10 to a lowered unloading or discharge position in which ingot 80 is substantially horizontal. Rollers 104 and 106 are then rotated as indicated at Arrows F and G to move ingot 80 (Arrow H) to remove ingot 80 from furnace 12 so that rollers 104 and 106 may return to the position shown in FIG. 9 for receiving an additional ingot segment. Removal mechanism 98 thus moves from the ingot receiving position of FIG. 9 to the ingot unloading position of FIG. 10 and back to the ingot receiving position of FIG. 9 so that the production of metal cast 34 and the coating thereof via the molten bath is able to continue in a non-stop manner.

Figure 11:
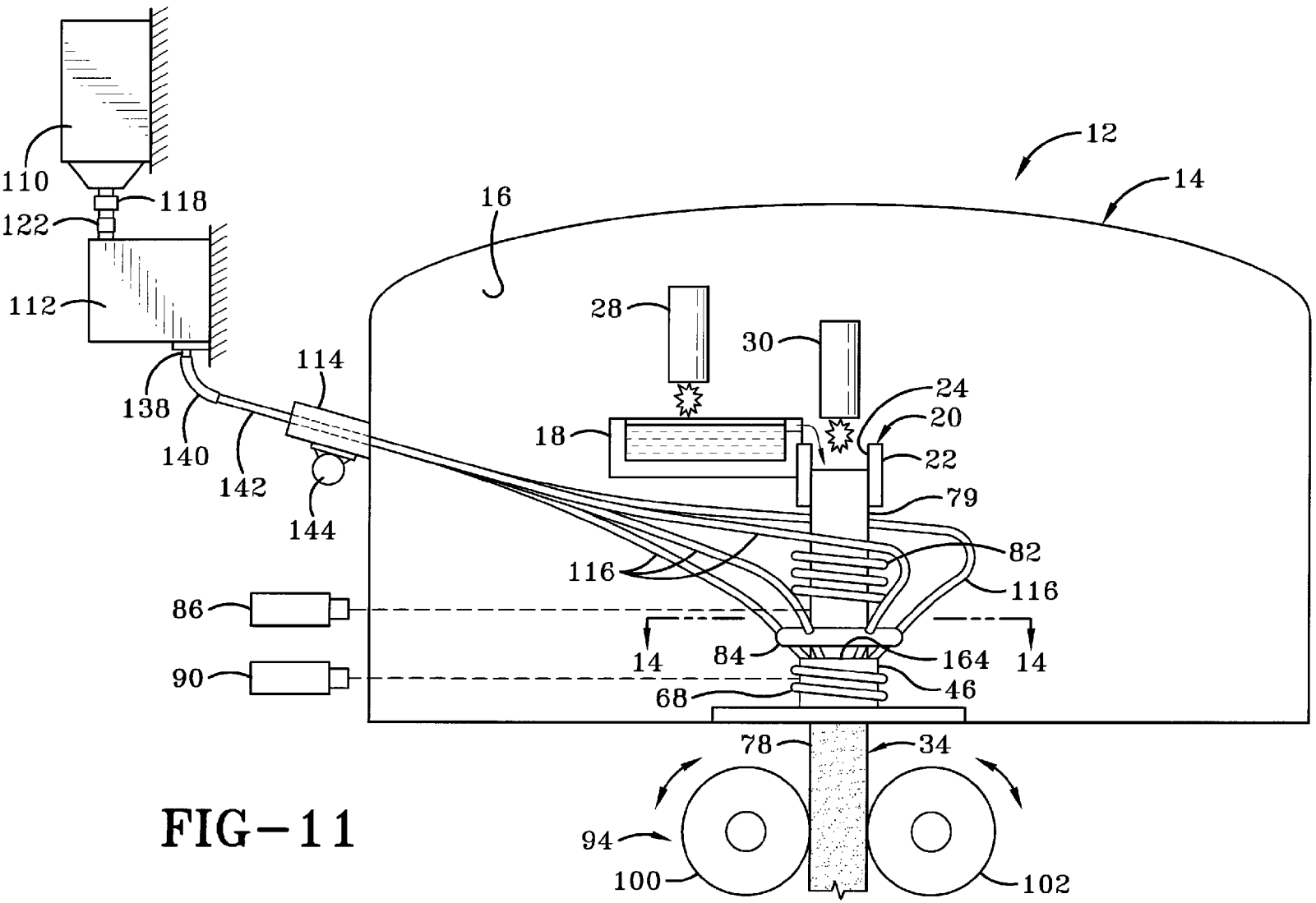
FIG. 11 is an enlarged diagrammatic elevational view similar to FIGS. 8-10 showing the feed system of the invention in greater detail.

The feed mechanism for feeding the solid particulate material of the present invention is now described in greater detail with reference to FIGS. 11-14. Referring to FIG. 11, the feed mechanism includes a hopper 110, a feed chamber 112, a mounting block 114 which is mounted on chamber wall 14 typically via welding, and a plurality of feed tubes 116 each of which is connected to and passes through cooling device 84. Four of feed tubes 116 are shown in FIG. 11 while all six of them are shown in FIG. 14. In practice, the number of feed tubes is typically between four and eight. These various elements of the feed mechanism provide a feed path through which the particles and solid coating material are fed into reservoir 62. Hopper 110, feed chamber 112 and feed tubes 116 are all sealed together with chamber 14 so that the atmosphere within each of these elements of the apparatus is the same. Typically, this atmosphere includes one of argon or helium and may be under a vacuum such as that associated with the use of plasma torches.

Figure 12:
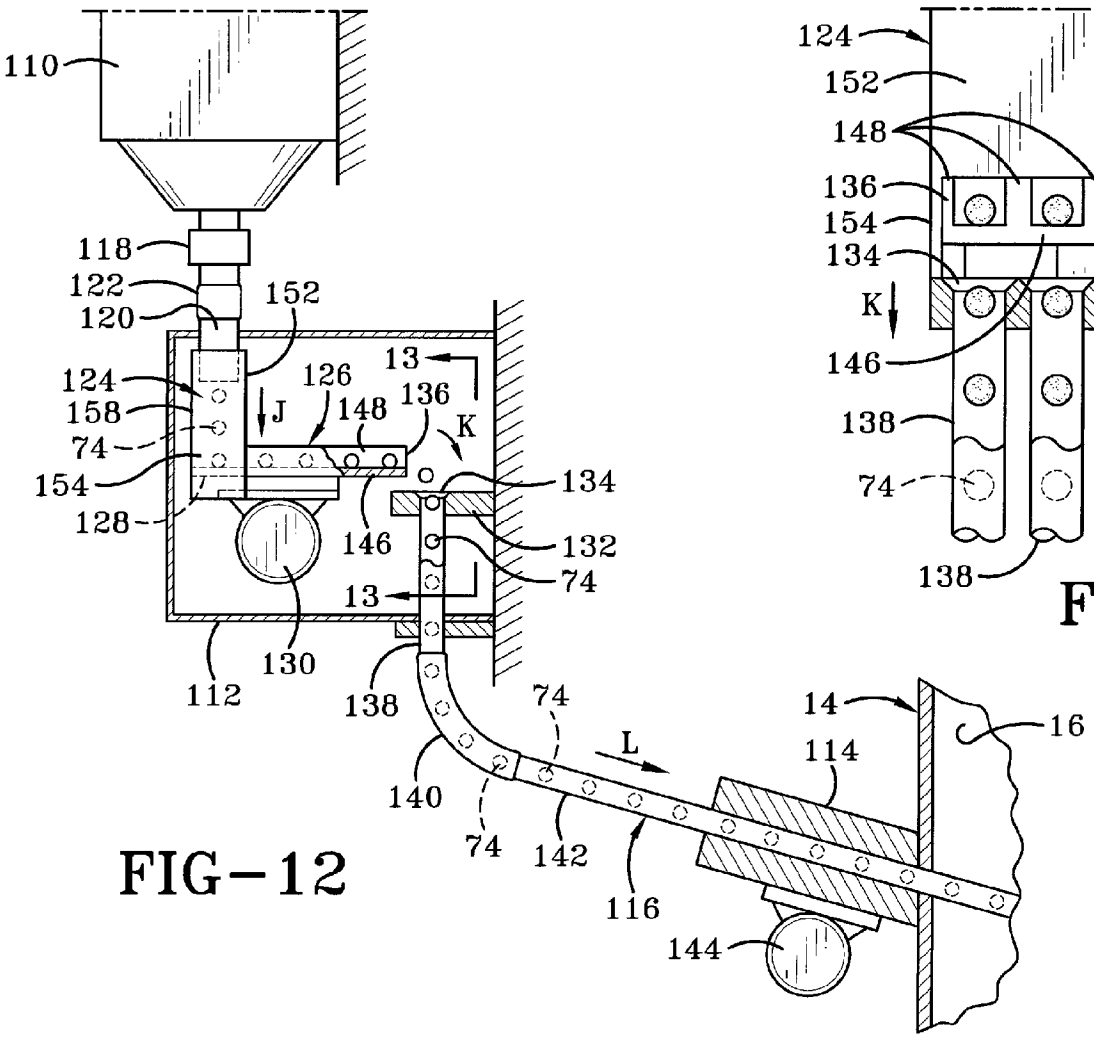
FIG. 12 is an enlarged fragmentary side elevational view of the hopper, feed chamber, feed tube and vibrators with portions shown in section.

Referring to FIG. 12, hopper 110 includes an exit port which is typically controlled by a valve 118. The exit port of hopper 110 communicates with a pipe mounted on the top wall of chamber 112 to provide an entry port 120 into said chamber. The connection between hopper 110 and entry port 120 preferably utilizes an annular coupler which may be formed as an elastomeric material which maintains the seal between hopper 110 and chamber 112 and allows for the removability of hopper 110 to be replaced with another hopper to expedite the switchover process during refilling of hopper 110. Entry port 120 feeds into a container or housing 124 disposed within chamber 112 which is connected to a vibratory feed tray 126 and extends upwardly from an entry end 128 thereof. A variable speed vibrator 130 is mounted on the bottom of tray 126 for vibrating said tray. A feed block 132 is mounted within chamber 112 and defines a plurality of beveled feed holes 134 below to an exit end 136 of tray 126. Each feed tube 116 includes a first tube segment 138 connected to feed block 132 in communication with holes 134. Each first tube segment 138 is connected to the bottom wall of chamber 112 and extends therethrough. Each feed tube 116 further includes a second flexible tube segment 140 connected to an exit end of first segment 138 and a third tube segment 142 connected to an exit end of flexible segment 140. Flexible segments 140 in part compensate for any misalignment between respective first and third segments 138 and 142. Each tube segment 142 extends continuously from a second tube segment 140 to an exit end above end wall 46 (FIG. 11). Thus, block 114 has a plurality of passages formed therethrough through which segments 142 extend. Another vibrator 144 is mounted on the bottom of block 114 to vibrate said block and tube segments 142.

Figure 13:
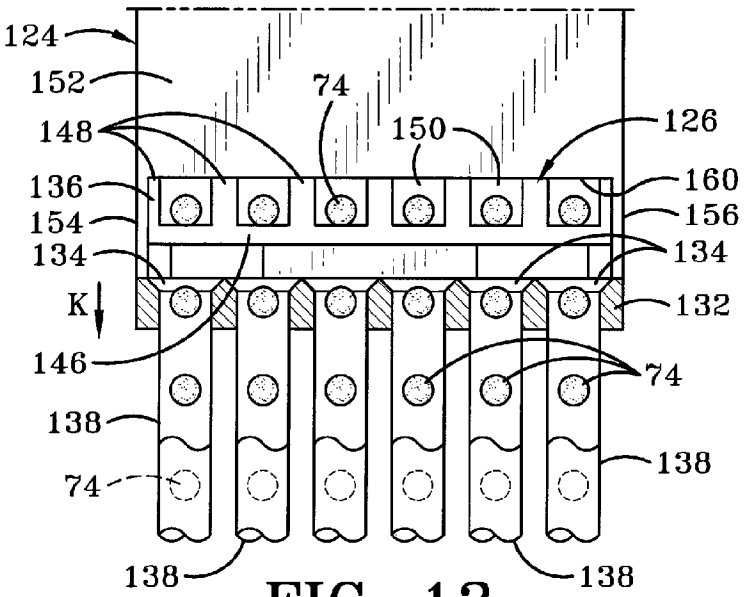
FIG. 13 is a sectional view taken on line 13-13 of FIG. 12.
Figure 14:
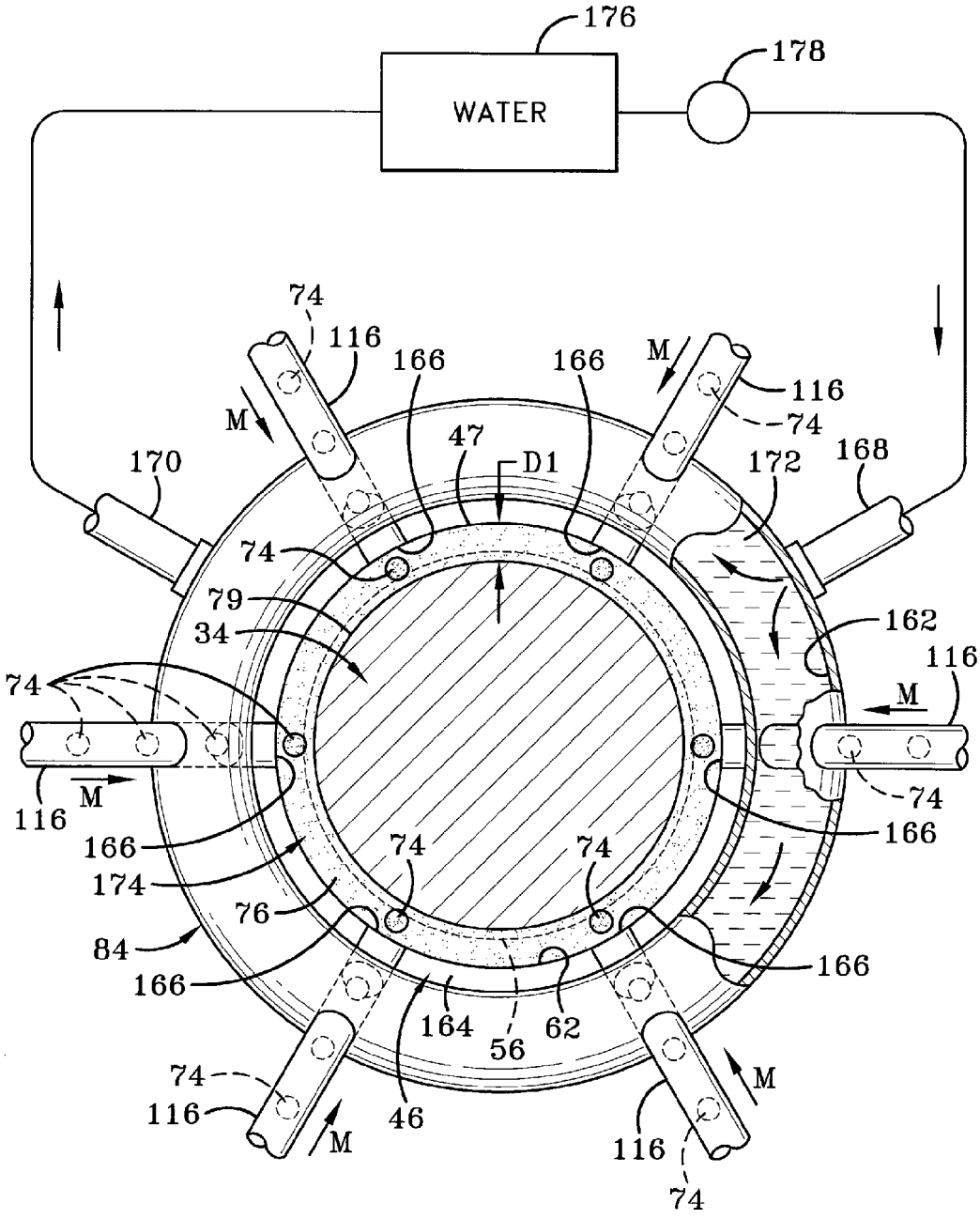
FIG. 14 is sectional view taken on line 14-14 of FIG. 11.
Figure 15:
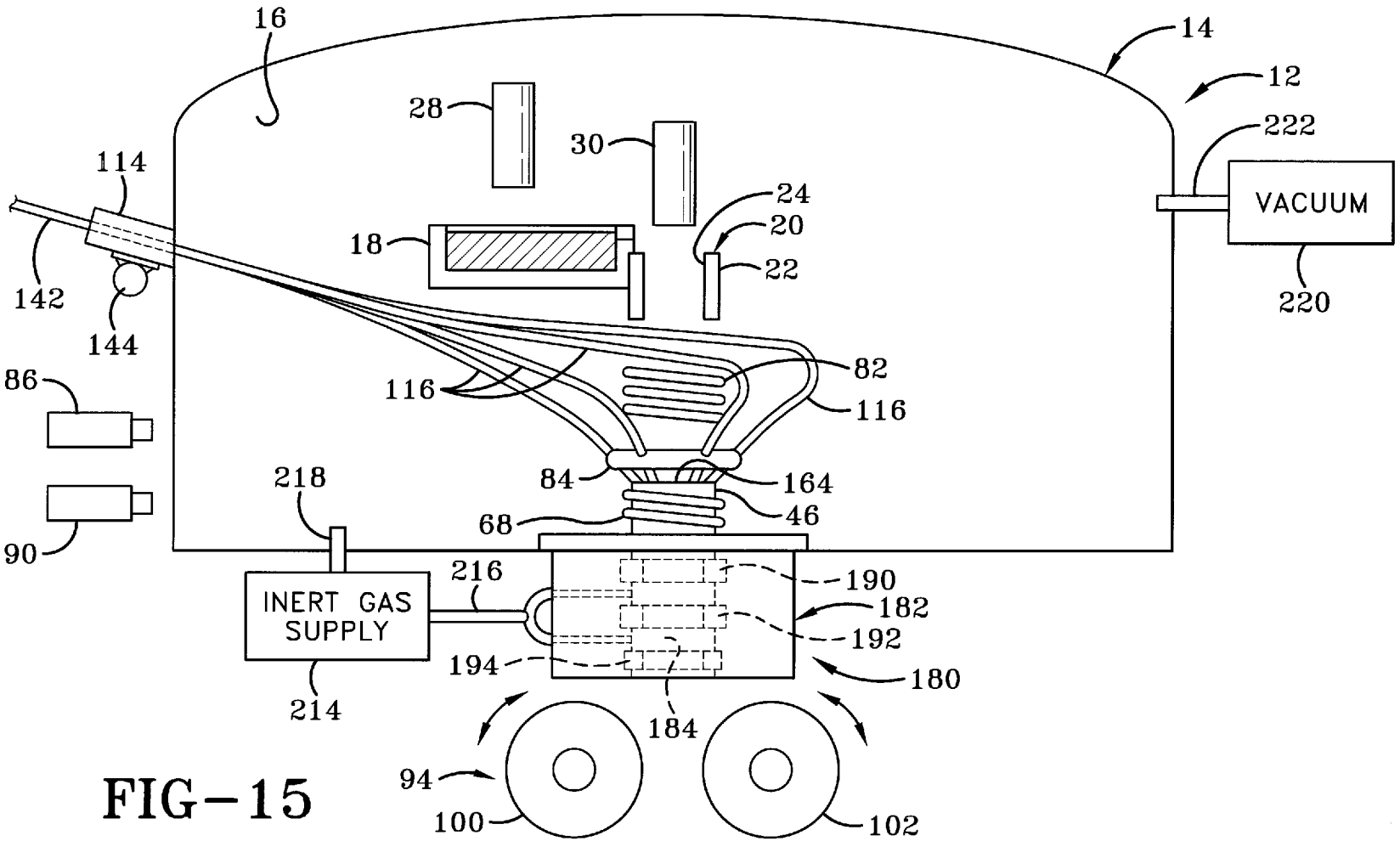
FIG. 15 is similar to FIG. 11 and shows the startup assembly used in the initial formation of an ingot using the molten seal of the present invention.
Figure 16:
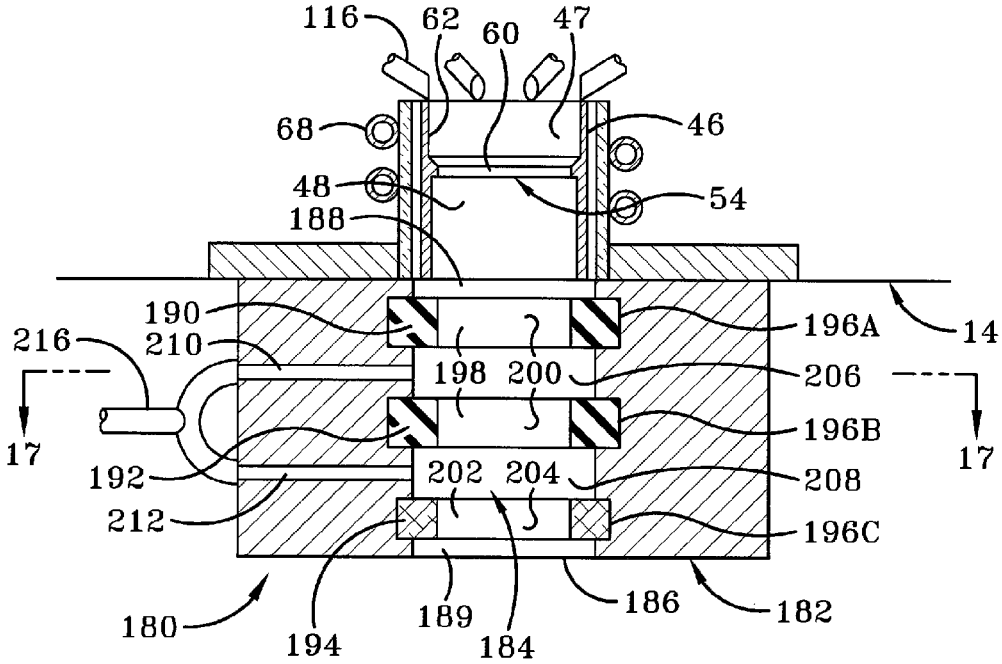
FIG. 16 is an enlarged sectional view taken from the side of the vacuum seal flange of the startup assembly.
Figure 17:
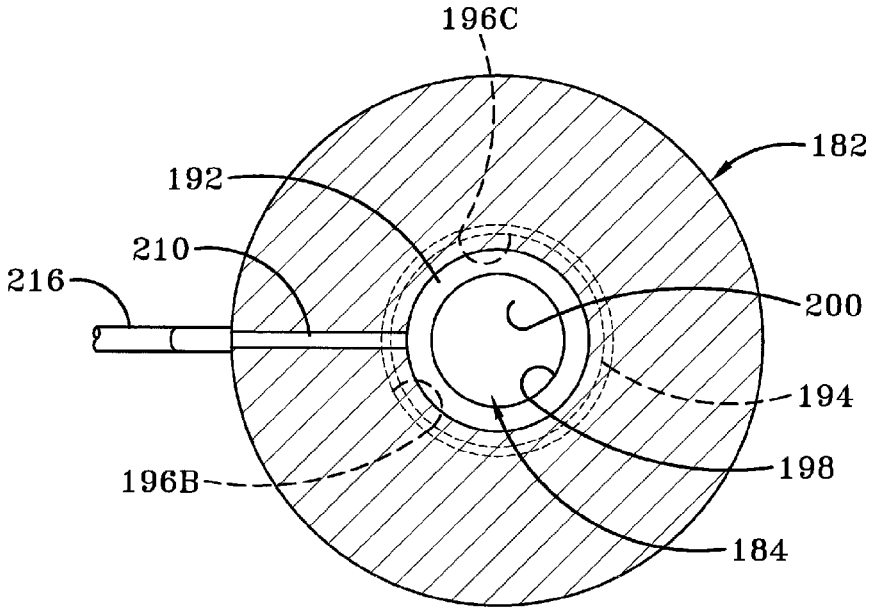
FIG. 17 is a sectional view taken on line 17-17 of FIG. 16.

Referring to FIG. 13, housing 124 and feed tray 126 are described in further detail. Tray 126 includes a substantially horizontal bottom wall 146 and seven channel walls 148 defining therebetween six channels 150 each extending from entry end 128 to exit end 136. While the dimensions of channels 150 may vary, in the exemplary embodiment they are approximately one half inch wide and one half inch high. Housing 124 includes a front wall 152, a pair of side walls 154 and 156 connected thereto and a rear wall 158 (FIG. 12) connected to each of side walls 154 and 156. Side walls 154 and 156 and rear wall 158 extend downwardly to abut bottom wall 146 of tray 126. However, front wall 152 has a bottom edge 160 which is seated atop channel wall 148 to create exit openings each bounded by bottom edge 160, bottom wall 146 and a pair of adjacent channel walls 148.

Referring to FIG. 14, cooling ring 84 is further described. Ring 84 has an annular configuration and is of a tubular structure which defines an annular passage 162. Ring 84 circumscribes the metal cast pathway through which metal cast 34 passes during the casting process. Ring 84 is disposed fairly close to cast 34 and a top surface 164 of wall 46 in order to provide cooling to feed tubes 116 adjacent respective exit ends 166 thereof. Ring 84 has entry and exit ports 168 and 170 to allow for the circulation of water 172 through ring 84. Entry port 168 is in communication with a source 176 of water and a pump 178 for pumping the water through ring 84 indicated by corresponding arrows in FIG. 14. A plurality of holes are formed in the side wall of ring 84 through which the smaller diameter feed tubes 116 pass in order to allow water 172 to directly contact feed tubes 116 adjacent their exit ends 166. Each feed tube 116 adjacent exit end 166 is closely adjacent or in abutment with top surface 164 of wall 46. Each exit end 166 and inner surface 47 of port wall 46 is spaced from outer periphery 79 of metal cast 34 by a distance D1 shown in FIG. 14. Distance D1 is typically in the range of ½ to ¾ inch and preferably is no more than one inch.

Furnace 12 is configured with a metal cast pathway which extends downwardly from the bottom of mold 20 and through the passage of reservoir wall 46. This pathway has a horizontal cross sectional shape which is the same as outer periphery 79 of cast 34, which is substantially identical to the cross sectional shape of inner surface 24 of casting mold 20. Thus, distance D1 also represents the distance from the metal cast pathway to inner surface 47 of wall 46 and the distance between said pathway and exit ends 166 of feed tubes 116.

The particulate coating material is shown as substantially spherical particles 74 which are fed along the feed path from hopper 110 to reservoir 62. It has been found that a soda-lime glass works well as the coating material due in part to the availability of such glass in substantially spherical form. Due to the relatively long pathway along which particles 74 must travel while maintaining control of their flow downstream toward reservoir 62, the use of spherical particles 74 has been found to greatly facilitate the feeding process through conduits 116 which are positioned at an angle suitable to maintain this controlled flow. The segments 142 of feed tubes 116 are disposed along a generally constant angle in spite of the diagrammatic view shown in FIG. 11. Particles 74 have a particle size somewhere within the range of 5 to 50 mesh; and more typically within narrower ranges such as, for example, 8 to 42 mesh; 10 to 36 mesh; 12 to 30 mesh; 14 to 24 mesh and most preferably 16 to 18 mesh.

The operation of the feed system is now described with reference to FIGS. 11-14. Initially, hopper 110 is filled with a substantial amount of particles 74 and valve 118 is positioned to allow the flow thereof via entry port 120 into housing 124 in chamber 112 as indicated at arrow J so that housing 124 becomes partially filled with particles 74. Vibrator 130 is then operated at a desired vibrational rate to vibrate tray 126 and particles 74 to facilitate their movement along channels 150 toward exit end 136, where particles 74 fall off of tray 126 and into tube segments 138 via holes 134 as indicated at arrows K in FIGS. 12 and 13. Particles 74 continue their movement through tube segments 140 and into tube segments 142 as indicated at arrow L toward block 114. Vibrator 144 is operated to vibrate block 114, tube segments 142 and particles 74 passing therethrough to additionally facilitate their movement toward reservoir 62. The spherical shape of particles 74 allows them to roll through conduits 116 and along the various other surfaces of the feed path, substantially facilitating their travel.

Particles 74 complete their travel along the feed path (arrows M) as they reach ends 166 and exit feed tubes 116 therefrom, as shown in FIG. 14. Particles 74 are pre-heated as they travel through segments 142 within the melting chamber, which is accentuated by their small size. However, particles 74 are maintained in the solid state until after they move beyond ends 166 to insure that feed tubes 116 do not become clogged with molten coating material. To insure that particles 74 do not melt within feed tube 116 adjacent exit ends 166, and to insure the integrity of feed tubes 116 in that region, pump 178 (FIG. 14) is operated to pump water from source 176 through ring 84 via entry and exit ports 168 and 170 so that water 172 directly contacts the outer perimeters of feed tubes 116 where they pass through passage 162 of ring 84. Thus, particles 74 are in the solid state at a distance from outer periphery 79 of metal cast 34 which is even less than distance D1. However, particles 74 are rapidly melted largely due to the heat radiating from the newly formed cast 34, with any additional heat needed provided by coil 68. Particles 74 thus are melted at a melting location 174 bounded by outer surface 79 of cast 34 and inner surface 47 of port wall 46, thus within distance D1 of outer periphery 79 of metal cast 34.

Another aspect of the present invention is illustrated in FIGS. 15-20 and is related to providing a seal around the ingot to prevent gasses from the external atmosphere from entering the melting chamber during initial startup of the continuous casting process. To that effect, the furnace of the present invention includes a vacuum seal assembly 180 which includes a rigid passage wall or collar 182 typically formed of metal and defining a passage 184 having a lower exit end 186 which communicates with ambient atmosphere external to the furnace and an upper entry end 188 which communicates with passage 48 whereby passages 184 and 48 form a single passage. Collar 182 has an inner periphery 189 which defines the passage 184 and in the exemplary embodiment is substantially cylindrical although it may have any suitable shape. Upper and lower high temperature polymer based sealing rings typically in the form of elastomeric O-rings 190 and 192, and a ceramic braided sleeve 194 are disposed along passage 184 to provide three flexible, removable annular sealing members respectively within annular grooves 196A-C which are formed in collar 182 and extend outwardly from inner periphery 189. O-rings 190 and 192 in the exemplary embodiment are formed of a high temperature silicone material. Other suitable sealing rings which are commonly available include buna or viton rings. Each O-ring 190 and 192 extends radially inwardly from inner periphery 189 and has an inner periphery 198 defining an O-ring passage 200. Likewise, ceramic braided sleeve 194 extends radially inwardly from inner periphery 189 and has an inner periphery 202 defining a sleeve passage 204. The transverse cross-sectional shape of passages 200 and 204 are substantially the same as that of narrower section 60 defined by the inner periphery of flange 54 and that of mold passage or cavity 26 defined by its inner surface 24. The transverse cross sectional shapes of passages 200 and 204 are slightly smaller than that of cavity 26 of mold 22 and also smaller than that of narrower section 60, which as previously noted is slightly larger than that of cavity 26. Lower O-ring 192 is spaced downwardly from upper O-ring 190 so that passage 184 includes a first passage segment 206 extending from the bottom of upper O-ring 190 to the top of lower O-ring 192. Likewise, ceramic braided sleeve 194 is spaced downwardly from lower O-ring 192 so that passage 184 includes a second passage segment 208 which extends from the bottom surface of O-ring 192 to the top surface of sleeve 194. Upper and lower gas inlet ports 210 and 212 are formed in collar 182 extending from its outer surface to inner periphery 189. Ports 210 and 212 are in fluid communication with passage 184 and an inert gas supply 214 via a gas conduit 216 connected to and extending therebetween. Supply 214 includes means for providing inert gas from supply 214 via conduit 216 to passage 184 at a low pressure which nonetheless exceeds the ambient atmospheric pressure and thus the pressure of the ambient reactionary gas external to the furnace. Thus, gas supply 214 may include a low pressure pump or a tank which is suitably pressurized by an air compressor or the like. Gas supply 214 is also in communication with melting chamber 16 via a gas feed conduit 218. A vacuum mechanism 220 is also provided external to melting chamber 16 and is in communication therewith via gas conduit 222 for the purpose of evacuating chamber 16.

Figure 18:
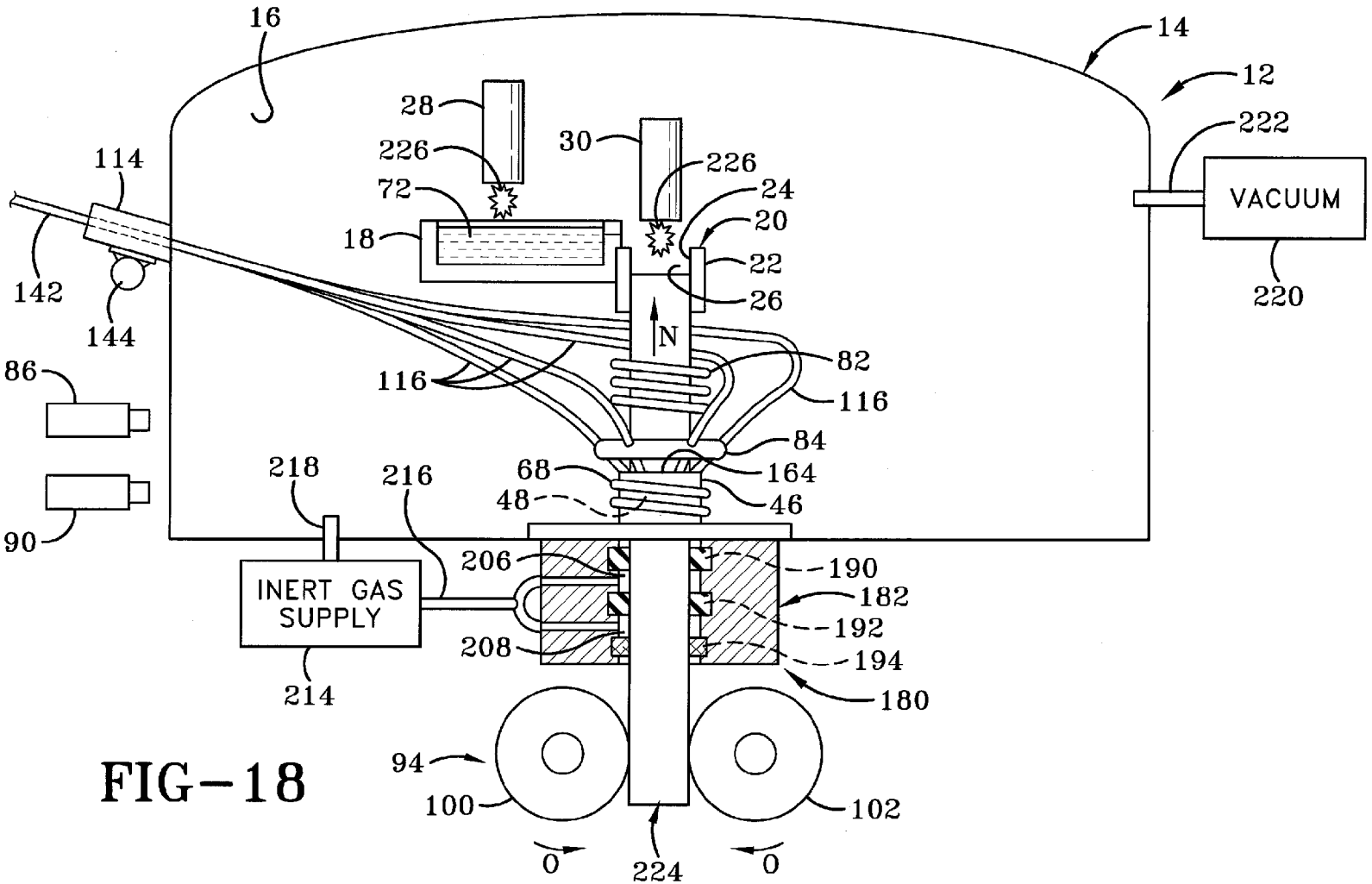
FIG. 18 is similar to FIG. 15 and shows the starter ingot stub having been inserted through the vacuum seal flange and into the continuous casting mold within the melting chamber.

The operation of furnace 12 during initial startup is now described with reference to FIGS. 18-20. Referring first to FIG. 18, a machined starter ingot stub 224 is inserted upwardly (arrow N) along the metal cast pathway through passage 184 and the passages defined by ceramic braided sleeve 194 and O-rings 190 and 192, passage 48, the passage circumscribed by cooling ring 84, heating coil 82 and into cavity 26 of mold 22. Starter stub 224 is machined so that its transverse cross sectional shape is the same as that of cavity 26 and only a very small degree smaller so that it forms a reasonably snug fit within cavity 26 as it slides upwardly therein. Rollers 100 and 102 are operated as shown at arrows O in FIG. 18 in order to effect the upward movement of starter stub 224. Once the starter stub 224 has been inserted in this manner, O-rings 190 and 192 form an airtight seal around the outer periphery of stub 224. Once starter stub 224 is inserted as shown in FIG. 18, low pressurized inert gas from gas supply 214 is supplied to segments 206 and 208 of passage 184 via conduit 216 and inlets 210 and 212. More particularly, the inert gas moves into the respective annular portions of segments 206 and 208 which circumscribe the outer periphery of starter stub 224 after its previously described insertion. More particularly, the annular portion of segment 206 into which the inert gas moves is defined between upper and lower O-rings 190 and 192, the outer periphery of starter stub 224 (or the metal cast pathway) and passage wall inner periphery 189. Likewise, the annular portion of segment 208 into which inert gas moves is defined between the bottom of O-ring 192, the top of annular sleeve 194, the outer periphery of starter stub 224 (or the metal cast pathway) and the passage wall inner periphery 189.

The cross sectional transverse shapes of passages 200 of O-rings 190 and 192 are, prior to insertion of starter stub 224, substantially the same as and slightly smaller than that of starter stub 224. The resilient compressible characteristics of the O-rings 190 and 192 allow them to expand slightly as starter stub 224 is inserted in order to match the cross sectional size of stub 224 and provide the gas tight seal previously noted. O-rings 190 and 192 are formed of a material which is impermeable to the inert gas. The cross sectional shape of sleeve 194 is very nearly the same as that of starter stub 224 and although it does not provide a gas tight seal, it does generally eliminate the vast majority of gas which may move from one side to the other of sleeve 194. Thus, it substantially minimizes the inert gas which would otherwise flow from segment 208 of passage 184 into the external atmosphere. Sleeve 194 is formed of a material which is permeable to the inert gas. Thus, inert gas may be exhausted from the annular portion of space 208 to the other side of sleeve 194 by passing through the pores of the material forming sleeve 194, between the inner periphery of sleeve 194 and outer periphery of starter stub 224, and also between the outer periphery of sleeve 194 and inner periphery 189 of the passage wall.

Once the gas tight seal is formed between starter stub 224 and O-rings 190 and 192, vacuum mechanism 220 is operated in order to evacuate the air from melting chamber 16. Typically, melting chamber 16 is evacuated to a base level below 100 millitorr and a leak rate of less than 30 millitorr within three minutes. The seal provided by the O-rings allows this to occur. Even though O-rings 190 and 192 are configured to provide a gas tight seal, or a substantially gas tight seal when the atmosphere within chamber 16 is at atmospheric pressure or under vacuum, the substantial reduction of pressure within chamber 16 may allow some leakage of gas into chamber 16 between starter stub 224 and O-rings 190 and 192 or between inner periphery 189 and said O-rings. Thus, the inert gas supplied to passage 184 is intended to allow only inert gas to enter melting chamber 16 via this potential leakage location, and thus not allow any air from the external atmosphere to enter melting chamber 16 around starter stub 224. After the melting chamber is evacuated and checked to ensure that the leak rate is limited to an acceptable level, the furnace is then back filled with inert gas from supply 214 via conduit 218. Melting chamber 16 is monitored to insure oxygen and moisture concentrations are sufficiently low to prevent contamination.

If these concentrations meet quality control standards, melting hearth plasma torch 28 is lit or ignited to form a plasma plume 226 to begin heating and melting the solid feed material within melting hearth 18 which is to be used for forming the metal ingot. Induction coils 68 and 82 are then powered for respectively inductively heating passage wall 46 and starter stub 224. Heat sensors 86 and 90 are used to respectively to monitor and control the temperature to which starter stub 224 and passage wall 48 are preheated. Although the exact temperature may vary with the specific circumstances, in the exemplary embodiment, starter stub 224 is preheated to approximately 2000° F. while reservoir passage wall 46 is preheated to a temperature of about 1700° F. to 1800° F. The mold plasma torch 30 is also lit or ignited to form its plasma plume 226 for heating the top of starter stub 224. Torch 30 may be used in the preheating process of starter stub 224. In addition, torch 30 is used to melt the top portion of starter stub 224 after which molten metal 72 is poured from hearth 18 into mold 20 to begin casting metal cast 34 so that stub 224 and cast 34 together form an ingot.

Figure 19:
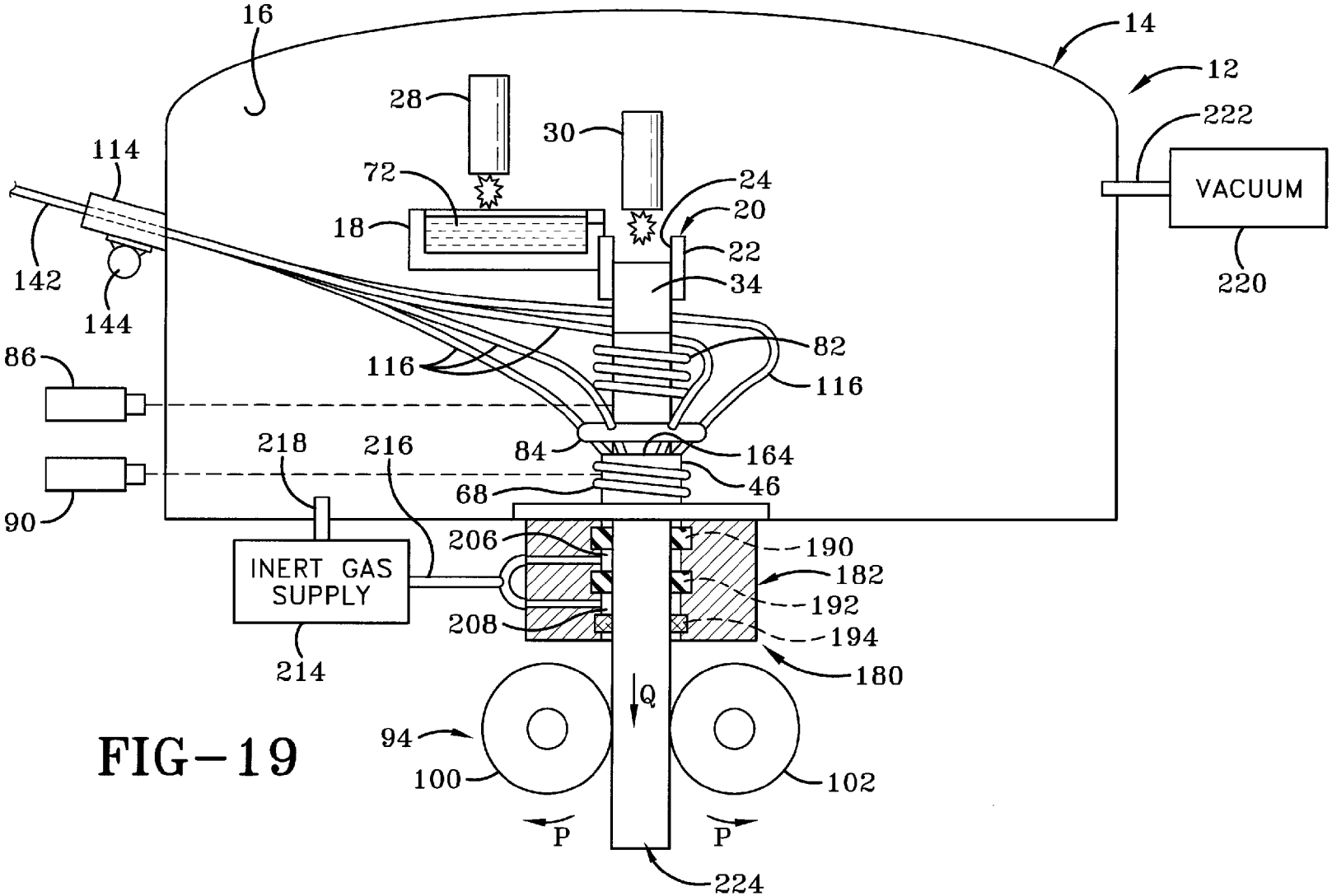
FIG. 19 is similar to FIG. 18 and shows an early stage of ingot formation atop the ingot starter stub.

As shown in FIG. 19, rollers 100 and 102 are rotated (arrows P) in order to lower (arrow Q) starter stub 224 and the metal cast 34 which is being formed atop starter stub 224 as molten material 72 is poured into mold 22 and solidified therein. Throughout this process, inert gas is continuously provided from supply 214 into passage 184 to ensure that there is no entry of the external atmosphere gasses such as oxygen and nitrogen into melting chamber 16.

Figure 20:
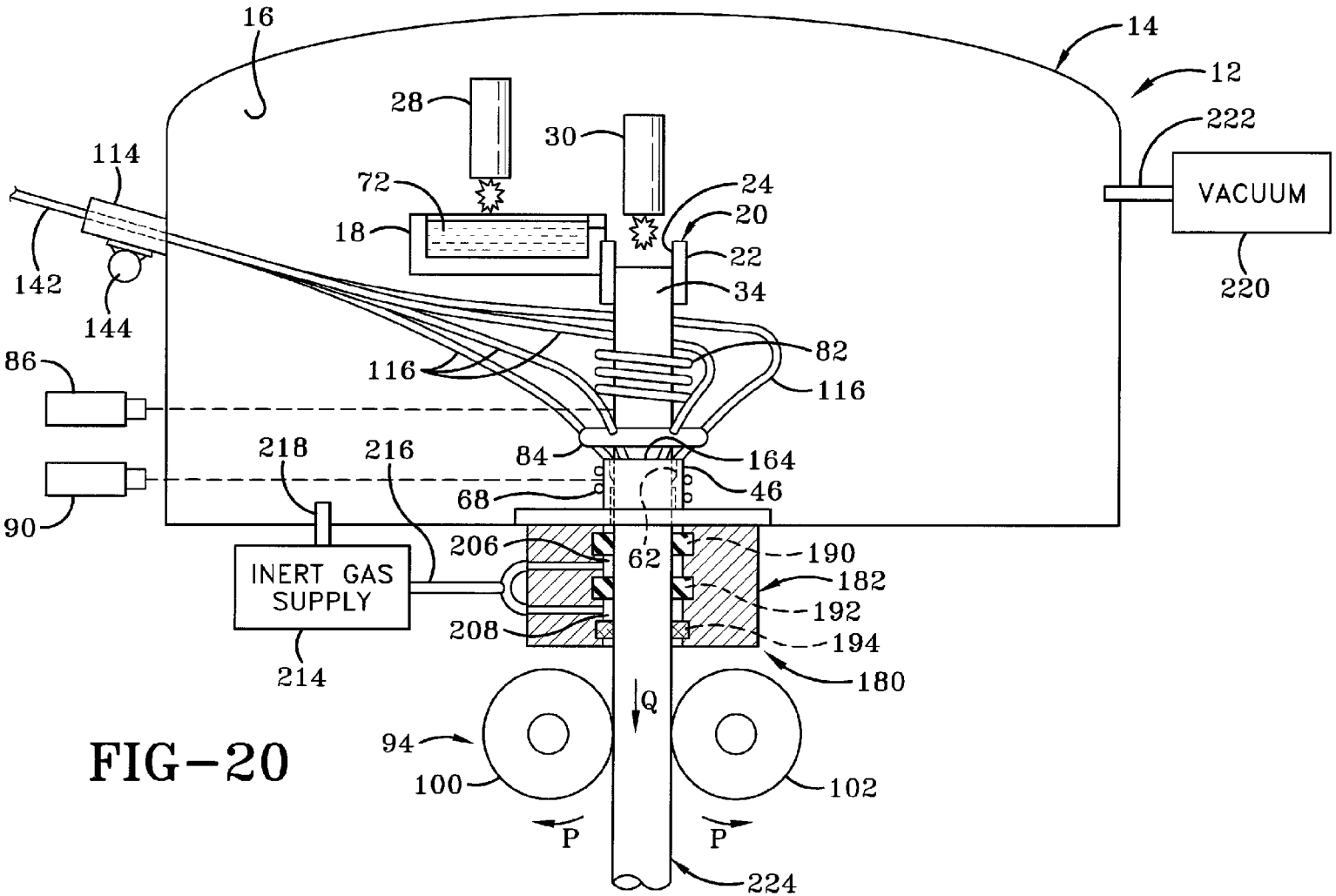
FIG. 20 is similar to FIG. 19 and shows a further stage of ingot formation and the initial formation of the molten seal.

As shown in FIG. 20, starter stub 224 and metal cast 34 are lowered until what is typically the hottest zone of the ingot—which may be a portion of starter stub 224 and/or metal cast 34—reaches reservoir 62, at which time rollers 100 and 102 are stopped in order to stop the movement of the ingot. While the ingot is stopped, particles 74 of coating material are fed into reservoir 62 as previously described with reference to FIGS. 11-14. Particles 74 are fed into reservoir 62 to a suitable level within about one minute. Typically it takes only about another minute to melt particles 74 in order to form the molten seal previously described within the reservoir 62. Thus, the lowering of the ingot is typically only stopped for about this two minute period to allow for the initial filling and melting of particles 74 within reservoir 62. While the ingot may need to be stopped for a longer period, this is typically no longer than about five minutes prior to initiating withdrawal of the ingot once again. This stopping period is needed in order to form a sufficient amount of molten material to provide the molten seal. That is, continued withdrawal of the ingot without this stopping period does not allow sufficient time to build up the needed volume of molten material to form the molten seal since the coating material making up the seal would exit the bottom of the reservoir at a rate which is too rapid to allow sufficient build up of molten material within reservoir 62. As noted above, this stopping period is nonetheless limited in duration in order to ensure that there is a sufficient heat energy from the metal cast 34 to melt particles 74 and keep the molten seal in a molten state.

When the starter stub and metal cast 34 is initially withdrawn after this stopping period, the withdrawal rate is relatively slow, and typically less than 1.0 inch per minute. The lowering of the ingot at this slower rate typically occurs for about ten minutes. The use of this slower withdrawal rate is related to the above noted need to maintain sufficient heat energy from the metal cast to melt particles 74 and keep them in a molten state. Once the molten seal is formed, there is no longer a need for the O-rings 190 and 192 to provide a seal to prevent external atmosphere from entering melting chamber 16, and thus no longer a need to provide inert gas into passage 184. Thus, movement of inert gas into passage 184 is stopped once the molten seal is formed. Once the slower ingot withdrawal is over, the ingot withdrawal rate is then accelerated to a rate typically greater than 1.0 inch per minute with a typical maximum rate of about 3.0 inches per minute.

As the ingot is lowered, particles 74 are fed at a sufficient rate to maintain the molten seal within reservoir 62 at a suitable level. The particle 74 feed rate is tied to the linear velocity of withdrawing cast 34 in order to maintain the volume of the molten material forming the molten seal at approximately the same level throughout the process although there is some room for variation as long the molten seal is maintained. More particularly, a faster withdrawal rate of metal cast 34 uses molten material from the molten seal more quickly in forming the coating around the metal cast and thus requires a relatively faster feed rate of particles 74 while a relatively slower withdrawal rate uses molten material from the molten seal less rapidly and thus requires a less rapid feed rate of particles 74 to maintain the molten seal. The rest of the casting process also continues at a controlled rate, and thus solid feed material is fed as needed into melting hearth 18 and melted therein to pour molten material into the continuous casting mold at the desired rate. The casting of metal cast 34 and the application of the coating material to the outer periphery of the metal cast via the molten seal continues as previously described.

When an entire campaign of casting is completed (which can easily last for six or seven days or more) O-rings 190 and 192 and ceramic braided sleeve 194 are removed and replaced in order to set up the furnace for a new campaign of continuous casting. Although the O-rings of the present invention are intended for temporary operation under the high temperatures involved during the start up process to provide the needed seal until the molten seal is formed, they nonetheless are not suitable for a long term continuous casting campaign, and thus will have deteriorated to a degree that they need to be replaced for initial startup of subsequent casting. Indeed, the sealing rings 190 and 192 typically will only provide the needed seal for less than one hour, most typically about ½ hour or so. While the ceramic braided sleeve 194 is configured for even higher temperature use, (for example, over 2000° F.) for longer periods it nonetheless needs to be replaced prior to setting up for a new campaign of casting. Although ceramic braided sleeve 194 might otherwise last longer, the interaction with the coating applied to the outer periphery of metal cast 34 degrades ceramic braided sleeve 194 to the degree that it needs to be replaced.

It is noted that the volume of molten material in the molten seal is relatively small and typically no more than can be melted during the previously noted stopping period in which the ingot is stopped in order to feed particles 74 into reservoir 62 and melt them to form the molten seal. One reason for keeping the volume of the molten material and molten seal to a relative minimum is to limit the amount of energy used to provide the necessary temperature for this melting process. In addition, the minimal volume is advantageous when the furnace needs to be shut down in a controlled manner. The shutdown of the furnace involves shutting off the flow of particles 74 along the particle feed pathway to reservoir 62. Ceasing the flow of particles 74 into reservoir 62 may be achieved almost immediately or within a relatively few seconds in order to quickly reach a state in which the volume of molten material in reservoir 62 is not increased. The shutdown of the furnace obviously also includes cessation of pouring additional molten material into mold 22. The metal cast 34 is lowered relatively quickly in order to ensure that the molten material forming the molten seal within reservoir 62 does not solidify prior to complete removal of the ingot therefrom. Thus, the temperature of the portion of metal cast 34 passing through reservoir 62 during this shutdown process should not decrease to below the melting temperature of particles 74. In the exemplary embodiment this temperature is about 1400° F., which is the approximate melting temperature of the glass particles which are typically used in making up particles 74. However, this temperature will obviously vary depending upon what material is used to form particles 74. When this portion of metal cast 34 does decrease below said melting temperature, the metal cast will become stuck and effectively weld itself to passage wall 46 along the annular flange forming the bottom of reservoir 62. The furnace would thus require a substantial amount of time for repair and removal of the ingot therefrom.

It is noted that alternate start up assemblies may be used in order to prevent external atmosphere from entering the melting chamber prior to the formation of the molten seal. However, such a start up assembly is more complicated than the one described above and creates its own problems. More particularly, a lower sealed chamber may be formed below the melting chamber which includes a rigid wall or door which may be closed to form the sealed condition of the lower chamber and opened or removed to open communication between the lower chamber and the external atmosphere. Such a configuration would require a larger annular sealing member which would not contact the outer periphery of the ingot but rather contact and form an airtight seal between the door and other rigid walls such as the bottom wall of the melting chamber or a rigid structure extending downwardly therefrom. Such a start up assembly would thus require that the melting chamber and the lower chamber both be evacuated and then back filled with inert gas prior to formation of the molten seal. Once the molten seal used with such a start up apparatus is formed, the sealed chamber can be opened to the external atmosphere by opening of the door to break the initial seal. In order to proceed with the continuous casting of the ingot using the molten seal, the door would thus have to be moved out of the metal cast pathway extending below the melting chamber. While the use of such a start up assembly is possible, it is relatively cumbersome and requires a substantial amount of additional structure compared to the use of vacuum seal assembly 180. The use of such a lower chamber may tend to cause the process to slow down, which can be problematic in keeping the metal cast at a desired temperature for melting the particles of coating material as previously discussed. While the lower chamber could be made substantially larger in order to minimize the problems related to slowing down the withdrawal of the ingot, doing so would add to the length of the lower chamber required. In addition, the size of the lower chamber would need to be large enough to accommodate the lowering mechanism such as rollers 100 and 102 in order to control the insertion of the starter stub as well as the withdrawal of the ingot. The use of vacuum seal assembly 180 eliminates these problems and the various structures and the lower chamber which would be required in order to create such a start up assembly.

Figure 21:
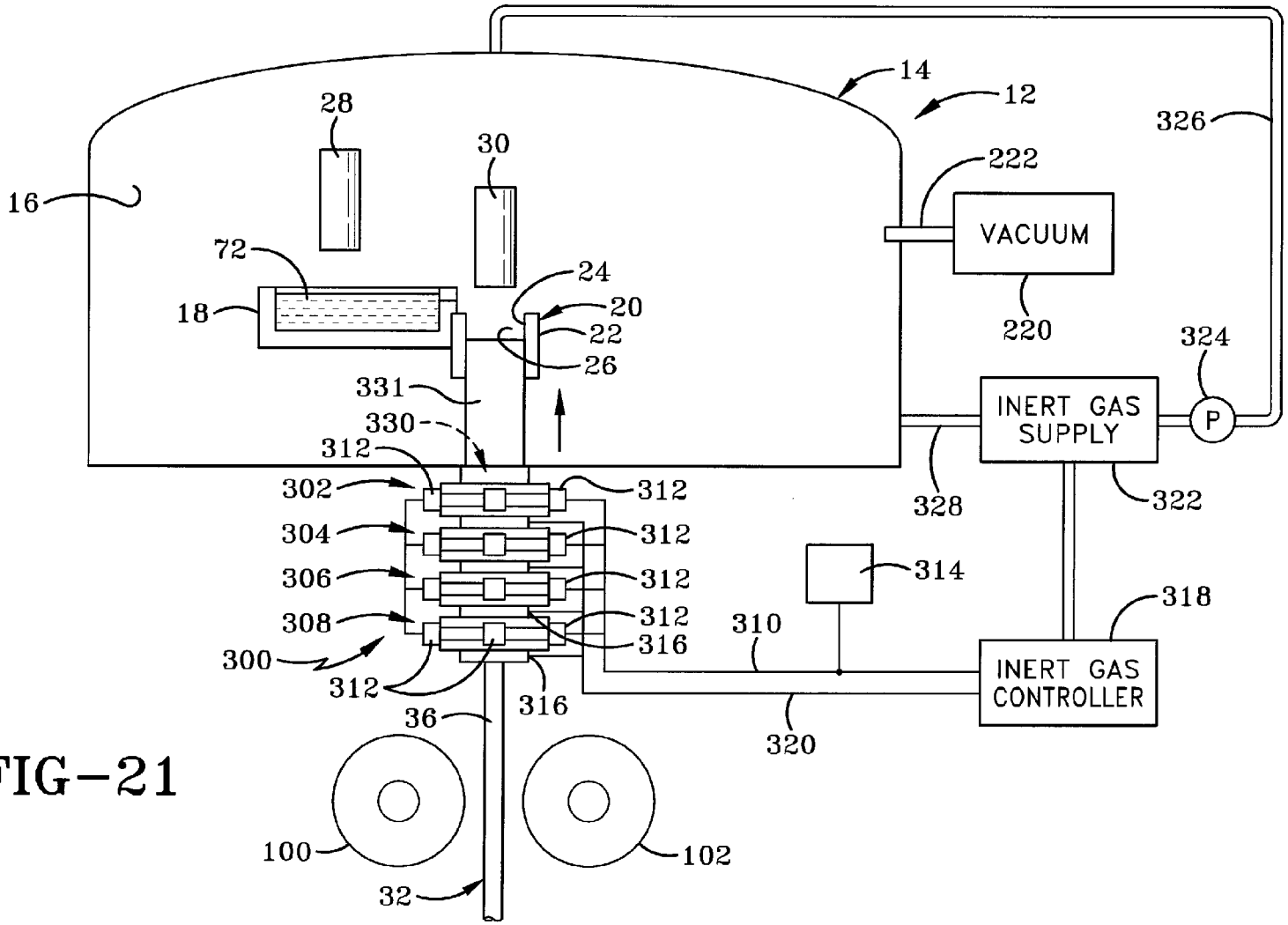
FIG. 21 is similar to FIG. 15 and shows a furnace with a first embodiment of a seal system and a starter stub extending from the melting chamber into a secondary chamber therebelow.
Figure 22:
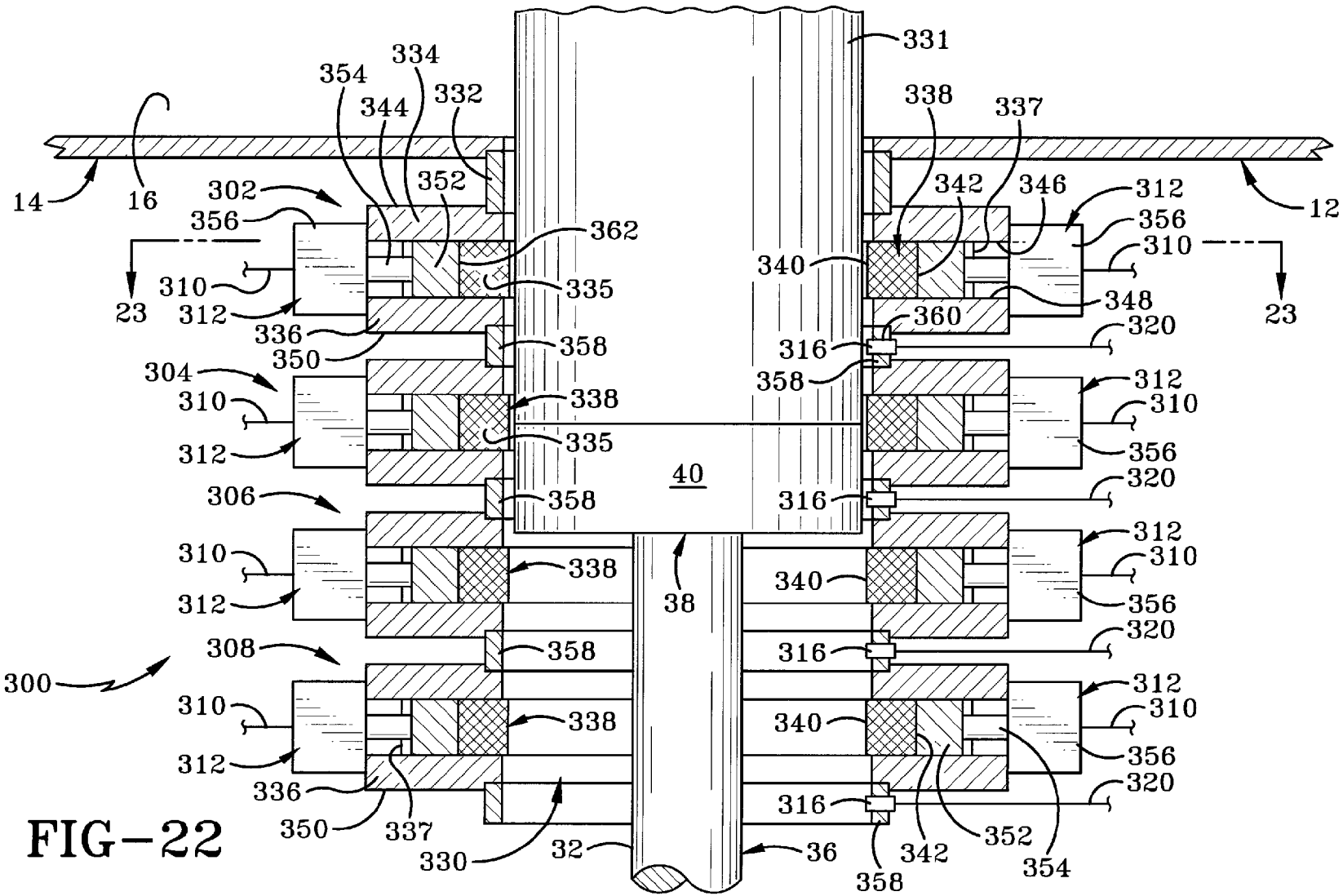
FIG. 22 is an enlarged sectional view taken from the side along the secondary chamber showing the seal assemblies, inert gas sensors and the starter stub on a withdrawal ram with all of the pressure cylinders in an inactivated state or position so that the backing members are not compressing the seals toward the ingot and the seals are in a decompressed state or disengaged position.

Referring to FIGS. 21 through 28, and in particular FIGS. 21 and 22, a first preferred embodiment seal system 300 is shown below melting chamber 16 and is axially aligned with withdrawal ram 32. Seal system 300 preferably includes a first seal assembly 302 directly below and downstream of mold 20 and melting chamber 16, a second seal assembly 304 directly below and downstream of mold 20 and melting chamber 16 the first seal assembly, a third seal assembly 306, and a fourth seal assembly 308 likewise directly below and downstream of mold 20, melting chamber 16 and one another. Seal assemblies 302 through 308 are preferably coaxially aligned with each other and stacked one on top of the other concentric about a longitudinal axis 333 of the metal casting (seen in FIG. 27). A plurality of hydraulic lines 310 respectively connect force producing mechanisms 312, such as hydraulic or pneumatic pressure cylinders, with a hydraulic or pneumatic control valve 314. Control valve 314 controls the actuation of force producing mechanism 312 during the sealing operation to move between activated and inactivated positions. A plurality of inert gas sensors 316 are connected to an inert gas flow controller 318 through sensor lines 320 so that sensors 316 are able to send a signal to controller 318. Inert gas sensors 316 may be any suitable sensor known in the art for sensing or detecting an inert gas such as helium or argon lost from interior chamber 16 downstream or below the respective seal. Controller 318 is also in electrical communication with control valve 314 and thus serves as a force producing mechanism controller for controlling the actuation of each mechanism 312. Controller 318 thus includes a microprocessor or computer which is programmed to control inert gas flow as well as control actuation of each mechanism 312 in an independent manner either in accordance with a predetermined set of steps or, for example, in response to signals received from inert gas sensors 316.

Casting furnace 12 also includes an inert gas supply 322 and a gas pump 324. Gas pump 324 forces the inert gas through input line 326 and the plasma torches to fill melting chamber 16. Used gas exits chamber 16 via output line 328 and reenters inert gas supply 322 to be recycled through the continuous feedback or recirculation loop formed of chamber 16, line 328, supply 322, pump 324 and line 326. While the feedback loop is generally a closed system, if gas loss sensors 316 detect that an excessive amount of inert gas has been lost from interior chamber 16, sensor 316 sends a gas loss signal to the inert gas controller 318, which directs the gas pump 324 to increase the supply of the inert gas within the melting chamber 16. Further, a gas loss sensor may be located within the melting chamber to detect a low gas condition where additional inert gas can be pumped into the chamber. Such a gas loss sensor may be a pressure sensor which determines the internal pressure of chamber 16 such that a sufficient pressure change indicates a loss of inert gas.

Figure 23:
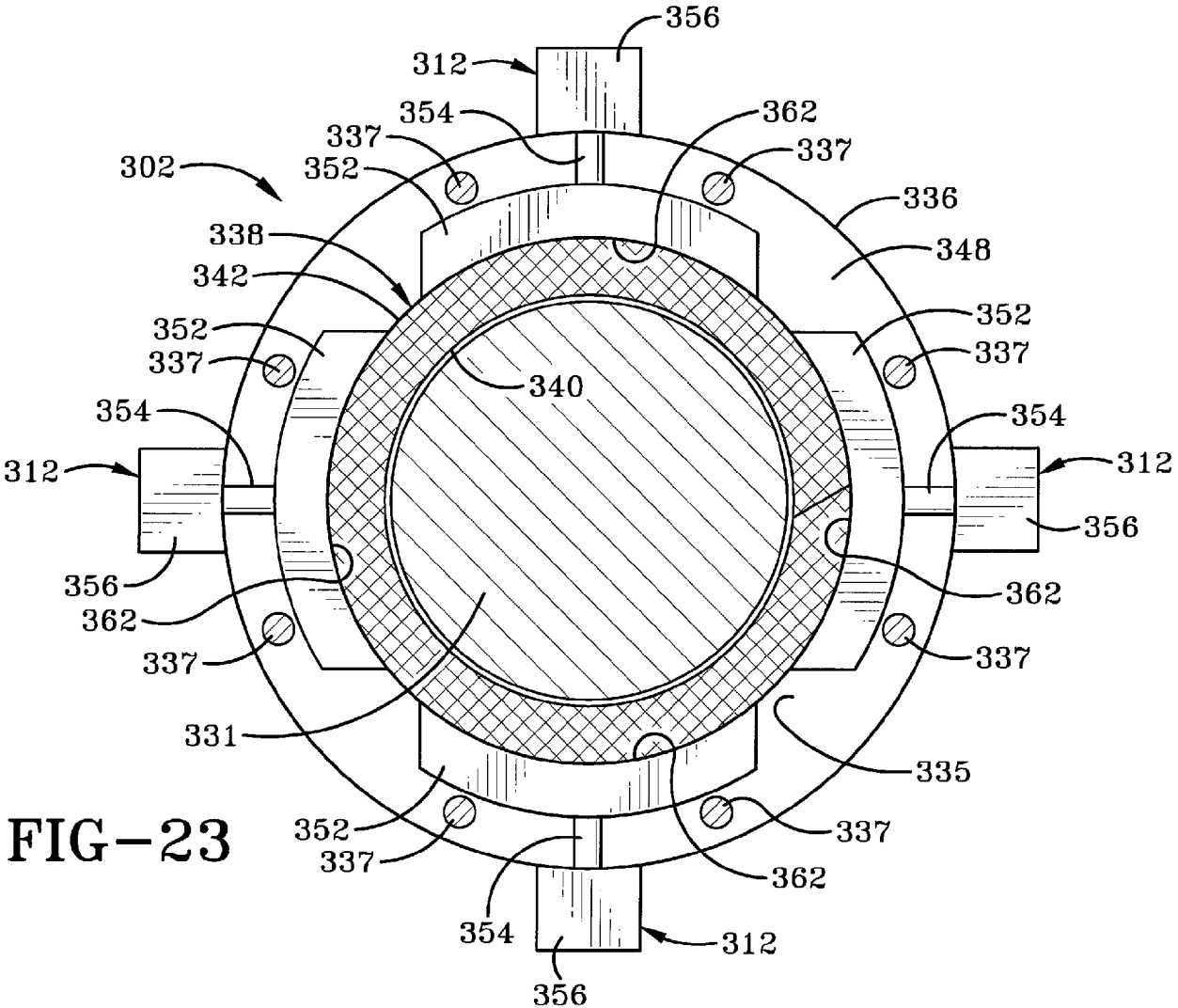
FIG. 23 is a sectional view taken on line 23-23 of FIG. 22.

Referring primarily to FIG. 22, chamber 330 is located below chamber 16 with its upper entry end in fluid communication with chamber 16 and its lower exit end in fluid communication with atmosphere external to chamber 16. An annular chamber wall defines secondary chamber 330 and is formed of the seal assemblies and an annular cylindrical rigid collar 332 rigidly secured to wall 14 at the bottom of melting chamber 16. First seal assembly 302 includes vertically spaced rigid annular circular upper and lower rings 334 and 336. Upper ring 334 of first assembly 302 is rigidly secured to the bottom of collar 332 and extends downwardly and radially outwardly therefrom. Rigid vertical support pins 337 extend from upper ring 334 to lower ring 336 to rigidly secure the two rings to one another and to set the vertical spacing therebetween. As best shown in FIG. 23, pins or rods 337 are evenly spaced circumferentially around rings 334 and 336.

A compressible annular seal 338 with a cylindrical inner surface 340 and a cylindrical outer surface 342 is secured between the upper ring and the lower ring radially inward of rods 337. Seal 338 is preferably composed of a ceramic braid, but may also be composed of a fiberglass, Kevlar, or any other suitable refractory sealing material. In particular, upper ring 334 includes a top surface 344 and a bottom surface 346, while lower ring 336 includes a top surface 348 and a bottom surface 350. An annular seal-receiving space 335 is defined between upper ring 334 and lower ring 336 and particularly bottom surface 346 and top surface 348. Seal 338 is secured within the annular receiving space. A rigid sensor collar 358 is rigidly secured to and extends downwardly from bottom surface 350 of lower ring 336 of first assembly 302 to a rigid connection with the top of upper ring 334 of second assembly 304. The sensor collar preferably includes an aperture 360 adapted to receive and secure inert gas sensors 316 below or downstream of the respective seals 338. Secondary chamber 330 is thus defined by the circular inner perimeters or surfaces of collar 332, seals 338 and each of the upper and lower rings 334 and 336 of the various seal assemblies 302, 304, 306 and 308, and each of sensor collars 358. Thus, the annular spaces between the respective pairs of upper and lower rings 334 and 336, including the respective annular seal-receiving space 335, extend radially outwardly from chamber 330.

Seal 338 is surrounded by four rigid backing members or plates 352 at seal outer surface 342. Force producing mechanisms 312 include the backing plate 352, a rod or piston 354, and a housing or cylinder 356 in which piston 354 is slidably received and driven by pressurized hydraulic fluid or air. As shown in FIG. 23, the four force producing mechanisms 312 are arranged at 90-degree angles along the perimeter of the seal. The four backing plates 352 nearly but not completely surround the respective seal 338 which they engage. More particularly, each backing member 352 has opposed ends such that one of the ends of a given backing plate is adjacent and spaced circumferentially from an adjacent end of the adjacent backing plate 352. Each backing member 352 is disposed radially outwardly of and in contact with the outer surface 342 of the respective seal 338. Each backing member 352 is also positioned radially inwardly of rods 337 within the annular space defined between the respective upper and lower rings 334 and 336 of the seal assembly. Each rod or piston 354 is rigidly secured to and extends radially outwardly from the outer perimeter of the respective backing member 354 within the annular space between the upper and lower rings. Each housing or cylinder 356 is thus positioned radially outwardly of the respective backing member 352 and piston 354, which during operation move relative to sidewall 14, housing 356 and the various components forming the chamber wall which define secondary chamber 330. In the exemplary embodiment, housing 312 is secured to the outer perimeter of rings 334 and 336. Although each mechanism 312 in the exemplary embodiment utilizes a hydraulic or pneumatic cylinder, other force producing mechanisms may be used. For instance, rod or piston 354 also may represent a threaded rod which threadedly engages a threaded hole formed in the housing or block 356, which may also include a drive motor for rotating the threaded rod to move the backing plate radially inward and outward for compression and decompression of the seal 338. Housing 356 may also house a gear drive operatively connected to the drive motor and threaded rod or utilize a belt drive to facilitate driving rotation of the threaded rod.

Each backing plate 352 preferably includes an inner surface 362 that is concavely curved as viewed from above and complementary shaped to the convexly curved seal outer surface 342. Each inner surface 362 forms or lies along an arc of a circle which is concentric about longitudinal axis 333 and has a radius of curvature which is substantially the same as that of outer surface 342. Force producing mechanisms 312 are thus configured to compress the seal about its periphery and force the seal inner surface 340 into contact with the outer surface 79 of the ingot and the starter stub. Outer surface 79 also serves to define or is coincident with the portion of the outer periphery of the metal casting pathway in secondary chamber 330 through which the ingot passes from chamber 16 to the external atmosphere. Each of seal assemblies 304 through 308 are structurally and functionally equivalent to assembly 302, with the only exception being that seal assemblies 304 through 308 are located below seal assembly 302 and secured to the adjacent seal assembly.

Figure 24:
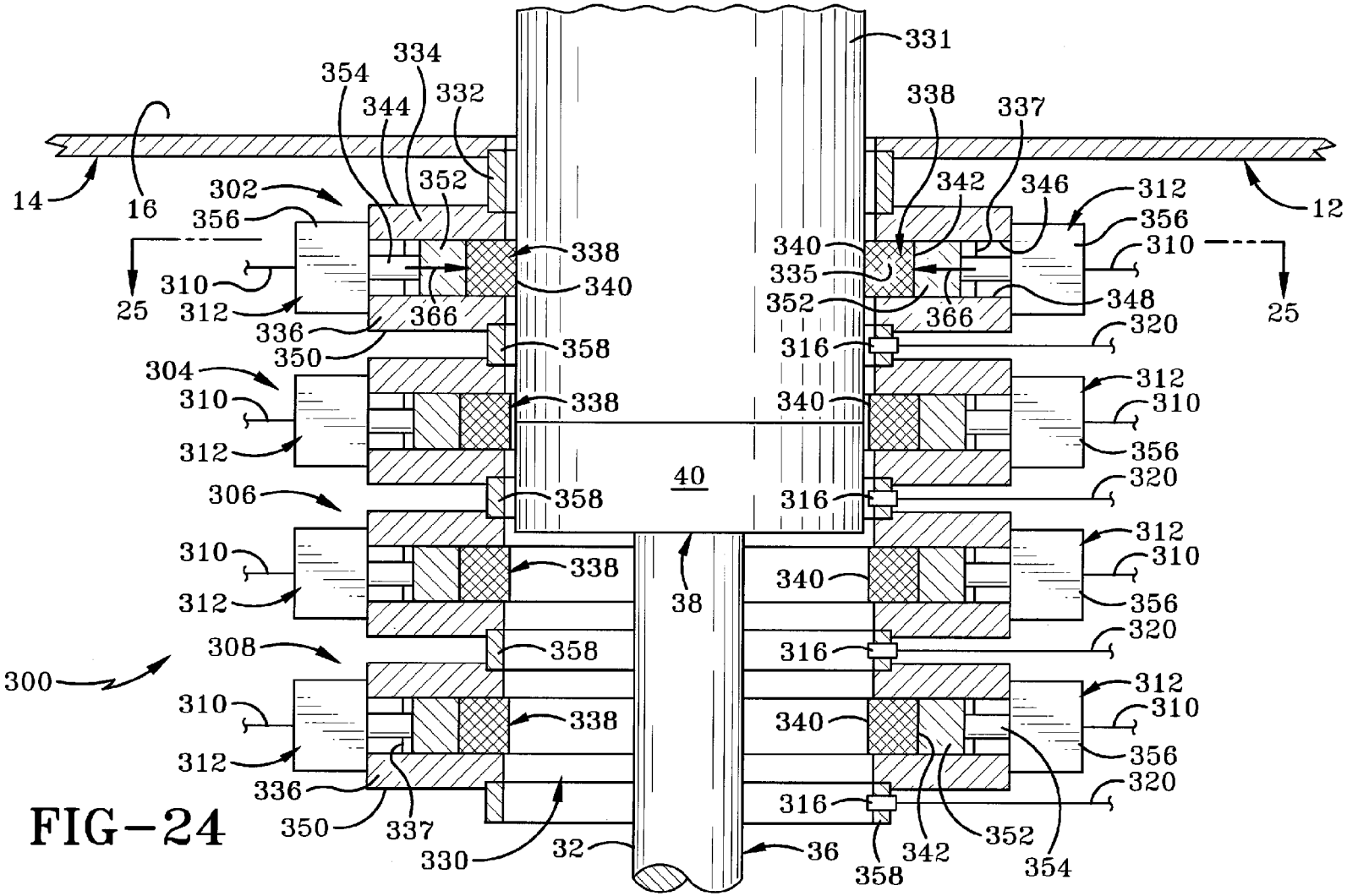
FIG. 24 is similar to FIG. 22 and shows the uppermost pressure cylinders in an activated position forcing the uppermost seal in a compressed state and engaged position against the starter stub of the ingot while the remainder of the cylinders and seals remain respectively inactivated and decompressed.
Figure 25:
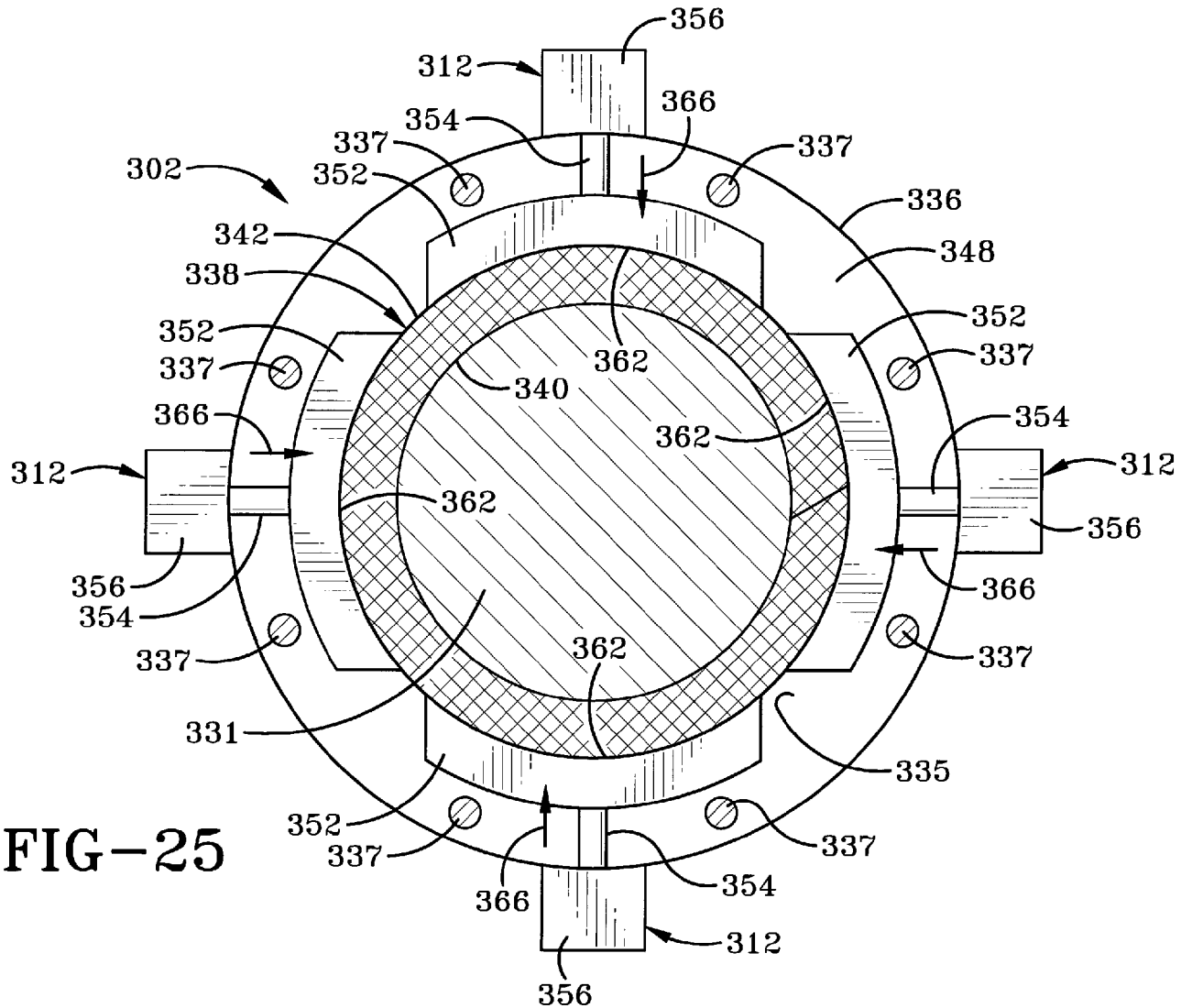
FIG. 25 is a sectional view taken on line 25-25 of FIG. 24.

The operation of the furnace utilizing the present seal assemblies is now described. FIG. 22 illustrates the casting furnace with a starter stub 331 resting on withdrawal ram 32 and seal assembly 302 near but not compressed against the starter stub. In this position, interior chamber 16 is exposed to the ambient air. Ram 32 is moved upwardly to lift and insert starter stub 331 upward through secondary chamber 330 into chamber 16 so that the upper end of stub 331 is within mold 20. With the starter stub 331 aligned with seal 338, controller 318 activates control valve 314 via a signal to force hydraulic fluid or air through lines 310 and moves rods 354 in the direction associated with arrows 366 (FIGS. 24, 25). The movement of the four rods 354 imparts respective movement and force on the four backing plates 352 of assembly 302, which compresses the corresponding seal 338 and forces seal inner surface 340 into contact with the starter stub.

As previously described with regard to the use of vacuum seal assembly 180 of the previous embodiment illustrated in FIGS. 15-20, the melting chamber 16 is then evacuated and backfilled with inert gas. More particularly, the force producing mechanisms 312 press the upper seal 338 against the outer perimeter of stub 331 in order to form a gas tight or substantially airtight seal which prevents air or other gas from moving between the melting chamber and external atmosphere between the seal and starter stub. More particularly, vacuum mechanism 220 is operated to evacuate the air from melting chamber 16 typically to a base level below 100 millitorr and a leak rate of less than 30 millitorr within three minutes. After the melting chamber is evacuated and checked to ensure that the leak rate is limited to an acceptable level, the furnace is then backfilled with inert gas from supply 322. Chamber 16 is monitored to ensure oxygen and moisture concentrations are sufficiently low to prevent contamination.

Figure 26:
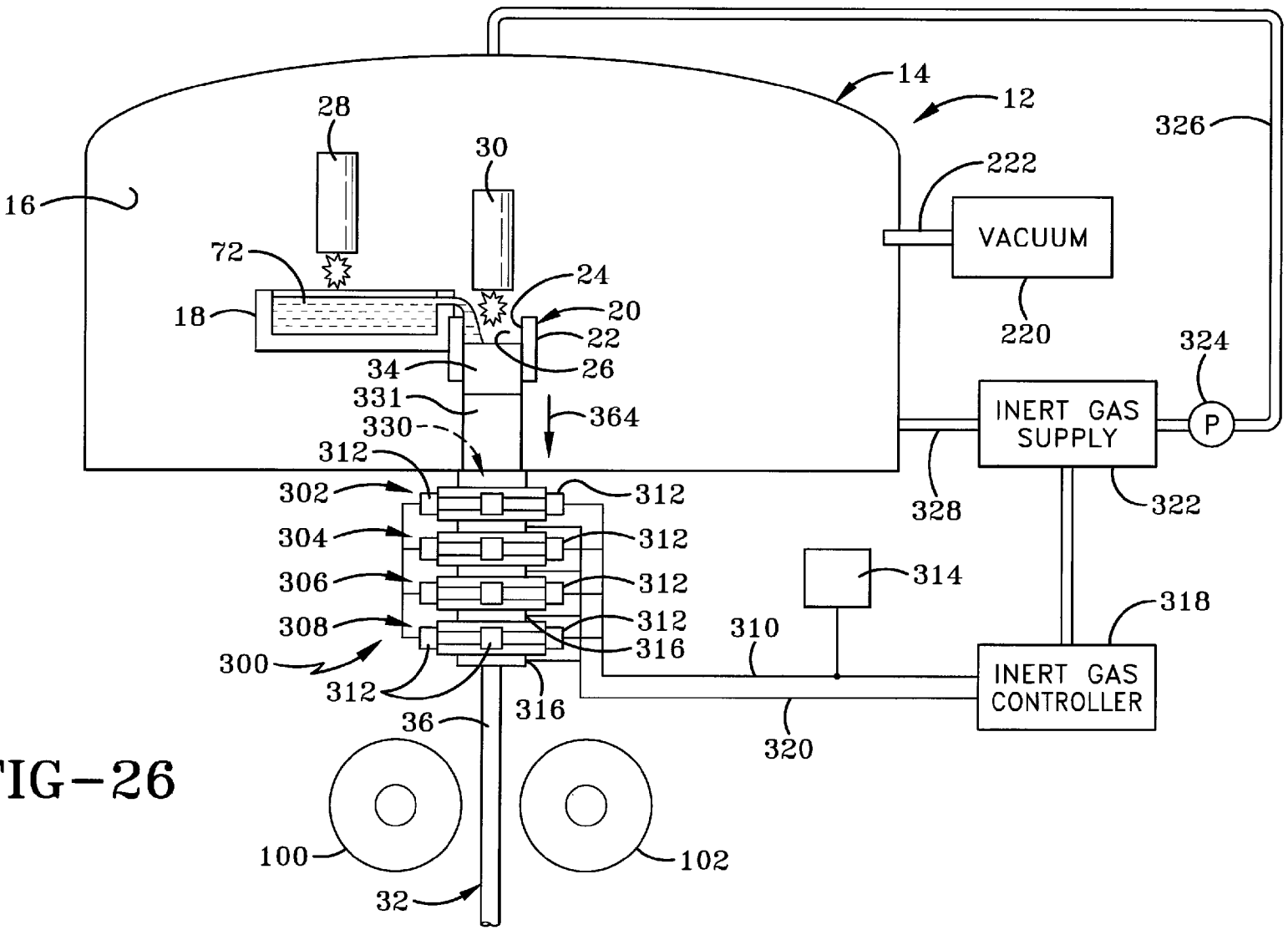
FIG. 26 is similar to FIG. 21 and shows the initial stage of forming a metal casting on top of the starter stub.

At this point, torches 28 and 30 are ignited in order to melt the metal to form molten material 72 within hearth 18 and to control the temperature within mold 20, as seen in FIG. 26. Molten metal 72 is poured on the starter stub to form metal casting 34. The metal casting 34 moves downward into secondary chamber 330 atop withdrawal ram 32 in the casting or downstream direction associated with arrow 364 (FIGS. 26-27).

Figure 27:
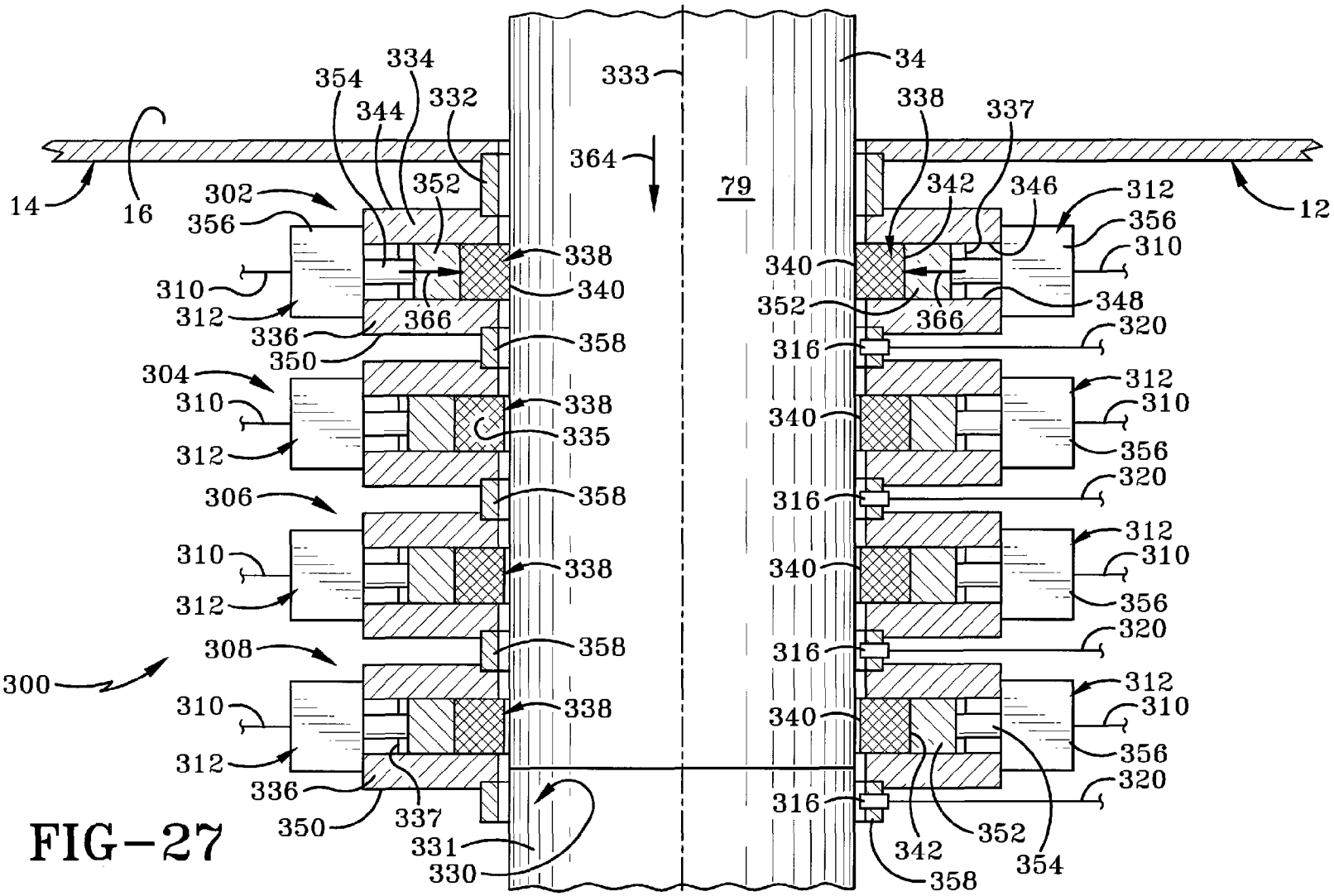
FIG. 27 shows the metal casting traveling through the secondary chamber with only the first seal forced against the metal casting.

FIG. 27 illustrates the movement of or force applied by backing members 352 and rods 354 of assembly 302 in the direction associated with arrows 366 while the metal casting is directed downward in the direction of arrow 364. Specifically, each hydraulic cylinder 312 continues to force the seal 338 radially inward towards and against the outer periphery of metal casting 34. As particularly seen in FIG. 27, when the hydraulic rod 354 moves inward and forces backing member 352 into seal 338, the metal casting is completely encircled and in contact with seal inner surface 340 during proper operation. Accordingly, this arrangement provides that the metal casting within chamber 16 does not contact the external atmosphere while it continues to cool prior to seal 338 of assembly 302. Once a given portion of the metal casting passes seal 338, the portion is exposed to the external atmosphere.

Figure 28:
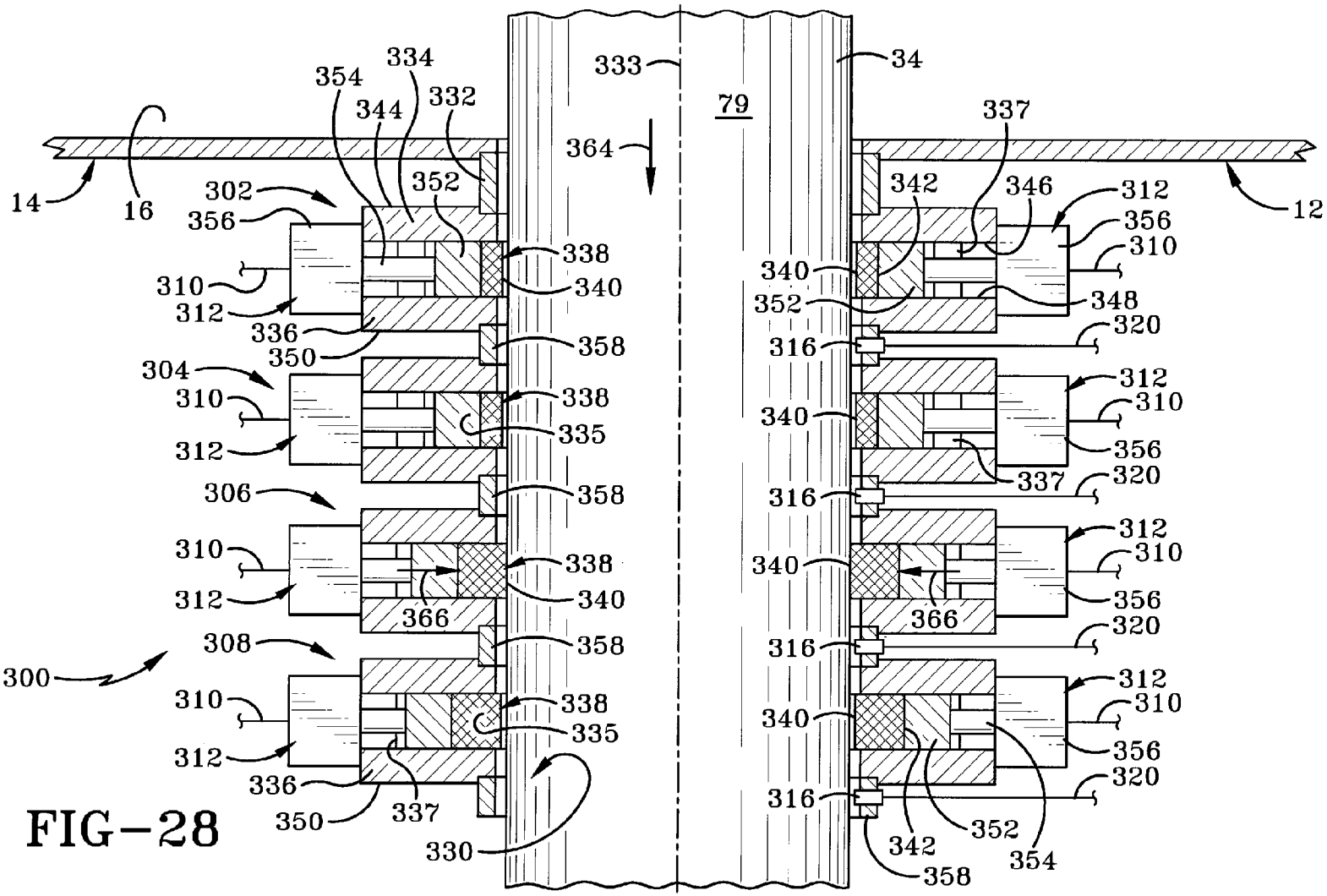
FIG. 28 illustrates the first and second seals worn down and disengaged from the ingot while the third seal is forced toward and into engagement with the metal casting during downward travel thereof.

During operation, the first or uppermost seal assembly 302 provides sealing until at least the upper inert gas sensor 316 detects an excessive inert gas leak condition. Once this inert gas leak or loss is sensed, sensor 316 sends an inert gas loss signal to control valve 314 via controller 318, which in response actuates the four force producing mechanisms 312 of the second seal assembly 304 to force the seal 338 thereof against the outer periphery of the metal cast 34 to provide a suitable seal which either replaces or is in addition to the seal provided by seal 338 of first assembly 302. At this point, sensor 316 which is downstream of first assembly 302 and upstream of assembly 304 is deactivated and the sensor 316 downstream of second assembly 304 and upstream of third assembly 306 is activated in order to detect inert gas loss downstream of the seal 338 of the second assembly. In the same manner as noted above, an excessive gas leak detected by this second sensor 316 signals control valve 314 via controller 318 to activate mechanism 312 of the third assembly 306 to force seal 338 against the outer perimeter of metal cast 334 to add to or provide the sole seal between interior chamber 16 and the external atmosphere. The activation and radially inward movement of the rods, backing members and seal 338 of assembly 306 is illustrated in FIG. 28 at arrows 366. As will be appreciated, one or more of the force producing mechanisms 312 maybe activated during the same time period such that more than one of the seals 338 is forced against the outer perimeter of the ingot during the casting operation.

The seal assemblies are thus typically activated in a sequential manner such that the uppermost or most upstream seal assembly 302 is activated to provide a seal against the ingot, followed by activation of the next downstream seal assembly 304, followed by seal assembly 306 and subsequently by seal assembly 308. However, as noted above, more than one of the seal assemblies may be activated simultaneously or during the same time duration. It is also noted that inasmuch as each of the seal assemblies includes four force producing mechanisms 312 in the exemplary embodiment, the controller 318 and control valve 314 are typically configured to operate the four mechanisms 312 of a given seal assembly in unison from the inactivated position to the activated position and vice versa. Although each set of force producing mechanisms of a given seal assembly may operate in unison, system 300 is configured such that each set of mechanisms 312 of a given seal assembly operates independently of each other set such that they may be activated or inactivated sequentially or otherwise.

FIG. 28 illustrates the seals 338 of first seal assembly 302 and second seal assembly 304 having been worn down by continuous use, preferably one or more days worth of use. FIG. 28 also illustrates that the first two seals 338 have been worn such that half or more than half of the thickness of the seals has been worn away as the outer surface of the ingot slidably engages the inner surfaces 340 thereof during casting and gradually tears away small bits and pieces of the seals. FIG. 28 also illustrates that the upper two force producing mechanisms 312 have been deactivated in order to move the respective rods, backing members and seals radially outwardly away from the outer surface of the ingot, and thus from their activated engaged positions to their inactivated disengaged positions. In FIG. 28, third seal assembly 306 is functioning identical to first seal assembly 302 wherein hydraulic cylinders force the seal radially inward to the activated engaged position into contact with the metal casting. Accordingly, the first preferred embodiment sealing system 300 provides a plurality of seals axially aligned with one another to provide continuous sealing for a significant time period such that the continuous casting process may proceed without delay for an extended period of time.

This operation and process continues until all of the seals are exhausted. Preferably, continuous casting operations will last for a full work week of five to seven days before all the seals are worn out. Casting is then discontinued with at least one seal still functioning so that the inert gas may be removed from chamber 16 and backfilled with air. The ingot is then completely removed from chamber 330, which provides the operator with the ability to change all of the seals at one time in order to set up for subsequent casting process. Although the preferred embodiment is illustrated with four seals, it is within the spirit and scope of the present invention to provide any number of seals and to locate the inert gas sensors at any position within the secondary chamber.

Figure 29:
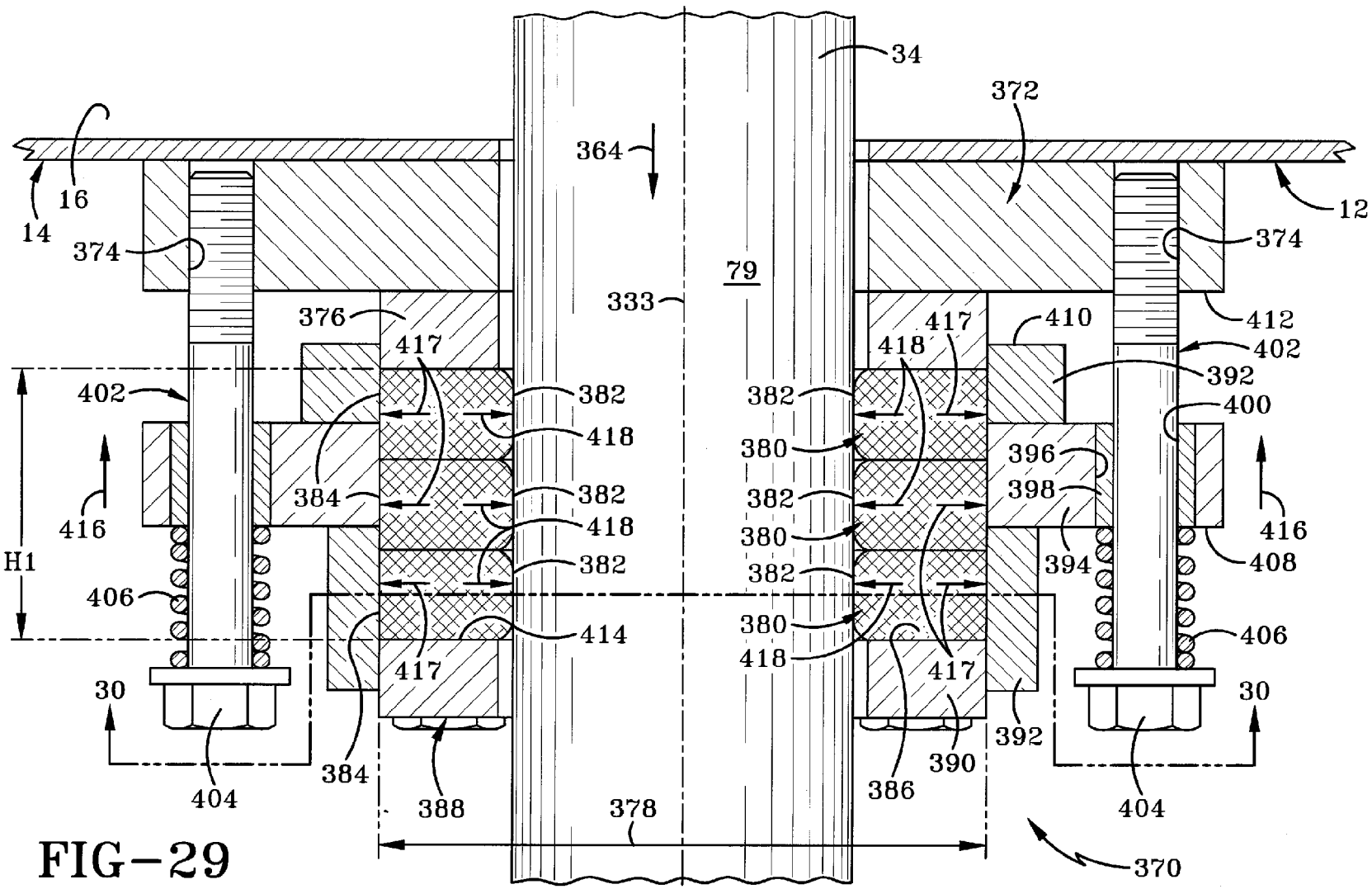
FIG. 29 is similar to FIG. 28 and shows a second embodiment of a seal system and an ingot traveling downward from the melting chamber into a secondary chamber with the chamber housing and seals vertically compressed to reduce the inner diameter of the seals.
Figure 30:
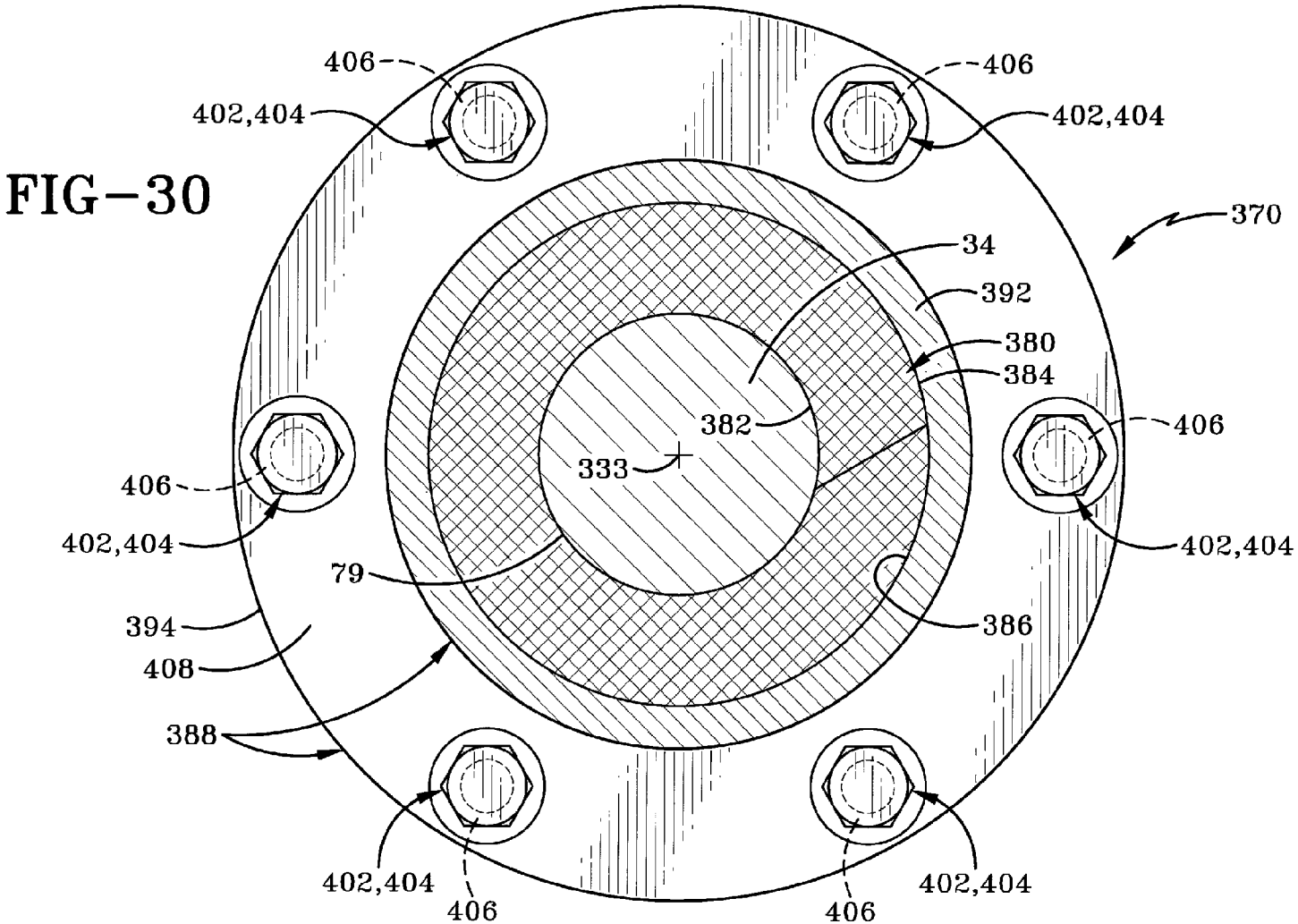
FIG. 30 is a sectional view taken on line 30-30 of FIG. 29.

FIGS. 29 and 30 illustrate a second preferred embodiment seal system 370. System 370 is secured to and extends downwardly from the bottom of side wall 14. System 300 includes a secondary chamber housing or wall 388 which defines an interior cavity or secondary chamber 386 which communicates with melting chamber 16 and the external atmosphere. The metal casting pathway previously described in the earlier embodiments extends downwardly through secondary chamber 386. As previously noted, the outer periphery of the ingot or metal casting 34 defines the outer periphery of the pathway. Chamber wall 388 includes an upper collar which includes an upper annular member or ring 372 which is rigidly secured to and extends downwardly from the bottom of sidewall 14, and a lower annular member or ring 376 which is rigidly secured to and extends downwardly from upper ring 372 and has an outer diameter which is smaller than the outer diameter of ring 372. A plurality of threaded holes 374 are formed in ring 372 radially outwardly of lower ring 376 and are circumferentially evenly spaced around ring 372 such that ring 372 serves as an internally threaded member. In the exemplary embodiment, there are six threaded holes 374. A plurality of annular seals 380 are stacked one atop the other within chamber 386 so that each adjacent pair of seals is in contact with the other. Each seal 380 includes an inner surface or perimeter 382 and an outer surface or perimeter 384 which defines an outer diameter 378. Ring 376 has an outer diameter which is nearly equal to and slightly smaller than outer diameter 378.

While rings 372 and 376 of the upper collar are rigidly secured to side wall 14 and are thus stationary, the remainder of chamber housing 388 serves as a rigid backing member which is moveable relative to side wall 14 and rings 372 and 376. More particularly, the remainder chamber housing 388 includes a lower annular member or ring 390, and an annular side wall which is rigidly secured to and extends upwardly from the outer perimeter of annular ring 390. The annular sidewall includes lower and upper annular members or rings 392 and an annular member or flange 394 which is rigidly secured between rings 392 and extends radially outwardly therefrom beyond their outer perimeters. The side wall 392, 394 has an inner surface or perimeter which is defined by the inner surfaces or perimeters of rings 392 and flange 394 and which in the exemplary embodiment has a diameter which is the same as diameter 378 of the outer perimeter of the seals 380. Thus, the outer diameter of ring 376 is nearly the same as and slightly smaller than the inner diameter of the side wall formed by members 392 and 394. In addition, outer surfaces 384 of seals 380 contact the inner perimeter of side wall 392, 394. Each of rings 376 and 390 have inner perimeters which are disposed radially inwardly of the inner perimeter of the side wall 392, 394. Six holes 396 are formed in flange 394 radially outward of the outer perimeter of rings 390, 392 and 376 and have disposed therein respective bushings 398 which themselves define respective openings 400 vertically aligned with threaded holes 374. Respective externally threaded members in the form of bolts 402 have shafts which extend through holes or openings 400 such that the externally threaded section of the bolt threadably engages the respective threaded hole 374. Each bolt 402 has an enlarged head 404 disposed below and spaced downwardly from flange 394.

A force producing mechanism 406, shown here in the form of a spring, is secured between a bottom surface 408 of flange 394 and the top of head 404. Spring 406 provides a constant vertically upward force or pressure (arrows 416) on flange bottom surface 408 and forces or biases flange 394 and seals 382 upward. Springs 406 thus bias the backing member formed of members 390, 392 and 394 vertically upwardly in the upstream direction relative to the stationary members 372, 376 and side wall 14 and thus parallel to the metal cast pathway and the direction of movement of the ingot during casting. The upward movement of the backing member illustrated at arrows 416 is translated to and compresses the seals 380 between the top surface of ring 390 and the bottom surface of ring 376 such that each seal 380 applies a radially outward force (arrows 417) against the inner perimeter of the side wall 392, 394 and a radially inward force (arrows 418) toward the metal casting pathway which during the casting process is also against the outer periphery of the metal casting. Outer sidewall 392 includes a top surface 410 arranged to contact a bottom surface 412 of upper ring 372 when the seals are worn to the degree that they should be replaced although seals 380 may be replaced before this occurs. As noted with the previous embodiment, seals 380 are typically formed of a ceramic braided material or the materials noted in the previous embodiment.

The casting process using system 370 is now described. As discussed in the previous embodiment, a starter stub is first inserted upwardly through the secondary chamber along the metal casting pathway such that its upright end is inserted into the continuous casting mold 20. To facilitate the upward insertion of the starter stub, the bolts 402 would be unthreaded or backed off by rotation in one direction in order to decompress springs 406 completely or sufficiently so that seals 380 would not unduly hinder the upward movement of the starter stub into position. The inner perimeter or surfaces 382 of seals 380 may be disengaged or spaced outwardly from the outer surface of the stub at this point. Once the starter stub has been inserted, the bolts 402 may be tightened by threading them into holes 374 by rotation in the opposite direction in order to compress springs 406 to the desired degree in order that seals 380 provide a sufficient seal between the chamber wall and the starter stub. More particularly, the tightening of bolts 402 causes the compression of springs 406 such that the tightening and the spring bias of springs 406 applies the vertically upward force on the backing member of housing 388 to compress seals 380, whereby the inner perimeters 382 thereof move radially inwardly such that the respective inner perimeter is decreased as is the corresponding inner diameter such that the inner perimeters form a seal against the outer periphery of the ingot. It is noted that the bolts may be tightened in order to force the backing member upwardly without the use of springs 406 although springs 406 when sufficiently compressed are able to provide a continuous upward force or pressure on the backing member over an extended time duration as the seals begin to wear and thus eliminate the subsequent additional tightening of the bolts in order to continue to provide the seal against the ingots.

Once this seal is formed, the melting chamber 16 is evacuated and backfilled with inert gas as discussed in the previous embodiment. As shown in FIG. 29, seals 380 have a total height H1 at the beginning stages of the process after the bolt has been tightened to compress springs 406 to the desired degree. After melting chamber 16 has been backfilled with inert gas, the casting process begins as described in the previous embodiment in order to begin forming the ingot, which moves downwardly such that the outer periphery of the ingot slides along the inner perimeters 382 of seals 380 in order to maintain the seal which separates the inert gas within chamber 16 from the external atmosphere. During this downward movement (arrow 364) the outer surface of the metal casting gradually wears away seals 380 along the inner surfaces thereof.

Figure 31:
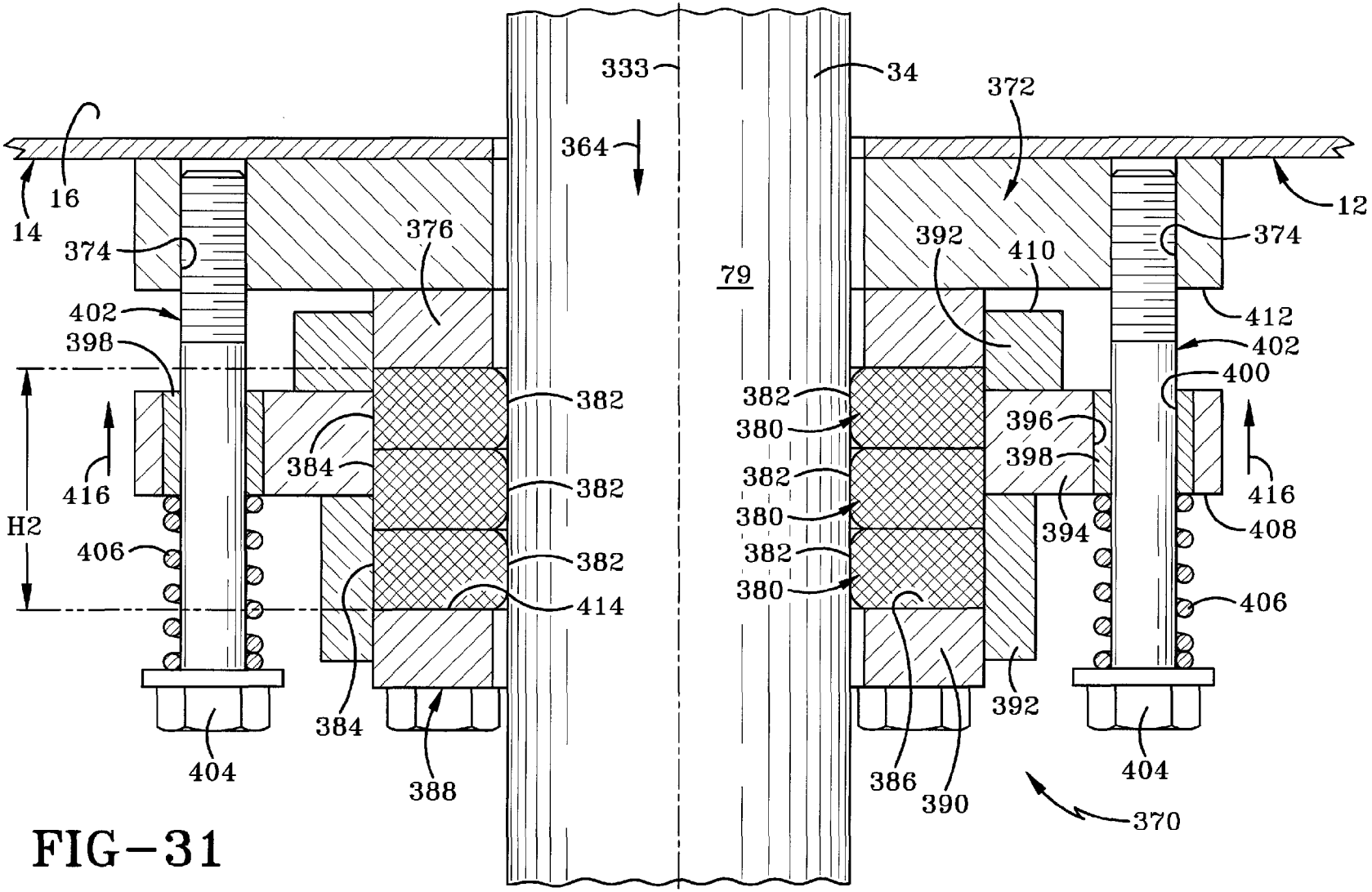
FIG. 31 is similar to FIG. 29 and shows the seals partially worn and further compressed in the vertical direction.

Referring to FIG. 31, the metal casting 34 has worn down seals 380 to the point that the seals have a height H2 which is smaller than height H1 Further, springs 406 are decompressed somewhat so that they are elongated further due to the distance flange 394 and the rest of the backing member has moved as a result of the seals 380 wearing down. As previously noted, contact between top surface 410 and bottom surface 412 may serve as an indicator that the seals need to be replaced. The casting process would thus be stopped as previously discussed so that bolts 402 may be unthreaded to remove the bolts and backing member from sidewall 14 and collar 372, 376 in order to remove the worn seals and replace them with new seals to set up the system 370 for subsequent use in the continuous casting process.

Figure 32:
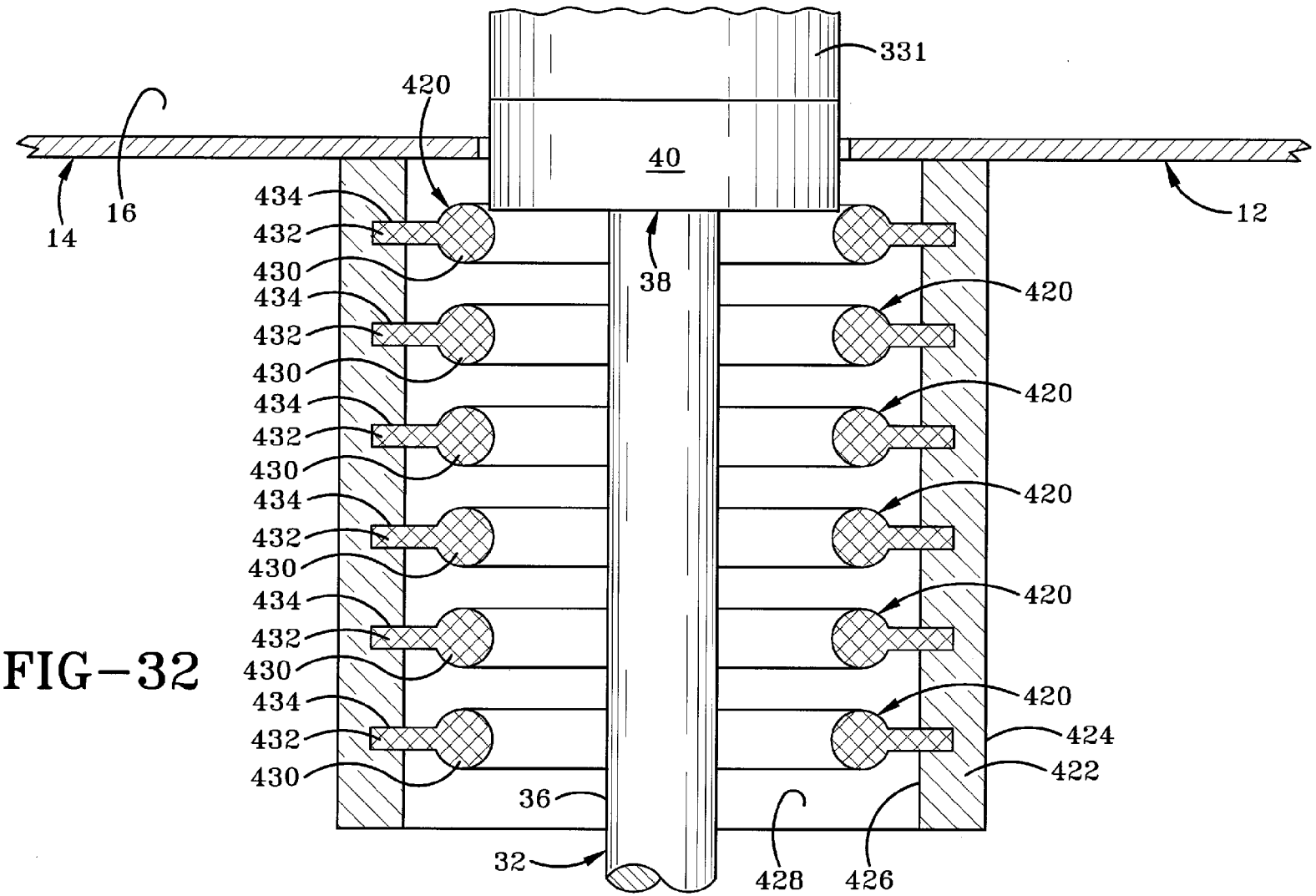
FIG. 32 is an enlarged sectional view similar to FIG. 31 and shows a third embodiment of a seal system with a starter stub seated atop a withdrawal ram adjacent the uppermost seal.
Figure 33:
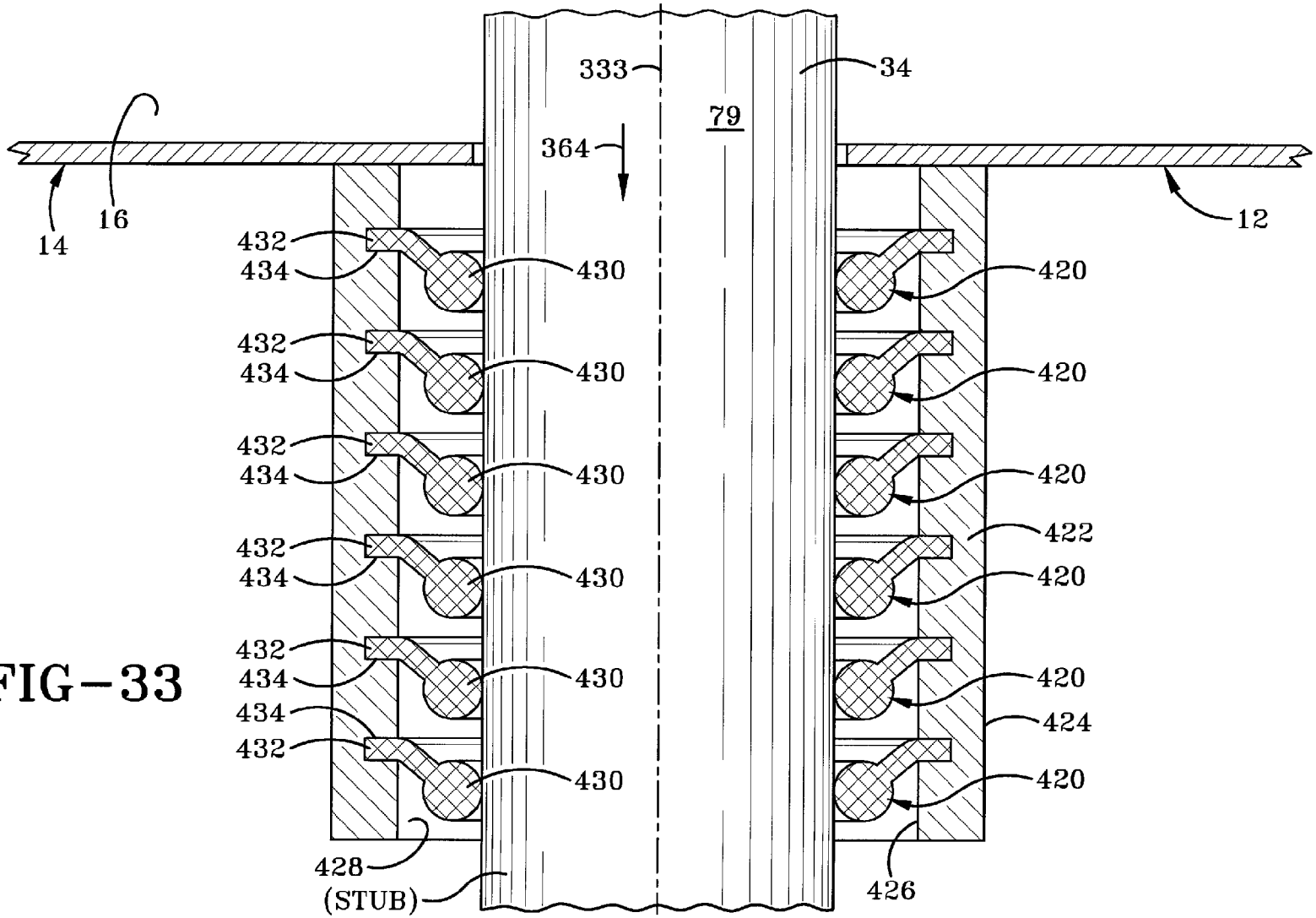
FIG. 33 is similar to FIG. 32 and shows the seals contacting the metal casting as it travels downward and bends the seals downward.

FIGS. 32 and 33 illustrate a third preferred embodiment with a plurality of annular tadpole seals 420 extending radially inward from a cylindrical wall 422. Seals 420 are also formed of a ceramic braided material or the other materials discussed in the previous embodiment. Cylindrical wall 422 preferably includes an outer surface 424 and an inner surface 426 defining an internal cavity 428. Seals 420 preferably include an enlarged head 430 having a generally circular cross section and an arm 432 having a generally flat horizontal cross section which is narrower than the head 430. Arm 432 is fixed within a cavity 434 defined within inner surface 426. Arm 432 may be removably or fixedly secured within cavity 434 and head 430 extends far enough within internal cavity 428 to contact metal casting 34 as it travels downward in the direction associated with arrow 364.

During operation, heads 430 are frictionally engaged with metal casting 34 and cylindrical outer surface 430 such that heads 430 are forced downward in the direction associated with arrow 364 and force arm 432 to bend in the same direction. Although the tadpole seals 420 provide some radially inward bias against the outer periphery of the ingot during the casting process, this force is typically insufficient to allow a single seal 420 to provide the necessary seal against the ingot to provide the separation between the inert gas atmosphere and the external atmosphere. Thus, a plurality of seals 420 is typically used in order to provide the degree of seal necessary. Once the seals are no longer effective, individual seals 420 may be replaced, or the entire assembly may be removed and replaced to provide continuous casting.

Thus, furnace 12 and the seals provide a simple apparatus for continuously casting and protecting metal castings which are reactionary with external atmosphere when hot so that the rate of production is substantially increased and the quality of the end product is substantially improved.

Accordingly, the continuous casting sealing method is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

Having now described the features discoveries, and principles of the invention, the manner in which the continuous casting sealing method is construed and used, the characteristics of the construction, and the advantageous new and useful results obtained; the new and useful structures, devices, elements, arrangement, parts, and combinations are set forth in the appended claims.

The invention claimed is:

1. A casting furnace comprising:

an interior chamber;

a chamber housing which is below the interior chamber and defines a secondary chamber which communicates with the interior chamber and atmosphere external to the interior chamber;

a metal casting pathway which extends from the interior chamber through the secondary chamber and is adapted to allow a metal casting to pass there through to the external atmosphere;

a compressible first seal which is within the secondary chamber and surrounds the pathway whereby the first seal is adapted to surround the metal casting; and an inner perimeter of the first seal which decreases in response to vertical compression of the secondary chamber.

2. The furnace of claim 1 further comprising a force producing mechanism operatively connected to the chamber housing for applying a vertical force thereon.

3. The furnace of claim 2 further comprising a spring of the force producing mechanism which biases the housing in the vertical direction.

4. The furnace of claim 3 further comprising a shaft which extends through the spring.

5. The furnace of claim 4 wherein the shaft has a threaded section.

6. The furnace of claim 5 further comprising a stationary member defining an internally threaded hole; wherein the threaded section of the shaft threadably engages the threaded hole.

7. The furnace of claim 1 further comprising a pair of bolts adjacent the chamber housing; and a portion of the chamber housing which is directly between the pair of bolts.

8. The furnace of claim 1 further comprising first, second and third shafts adjacent the chamber housing; and first, second and third springs respectively mounted on the first, second and third shafts.

9. The furnace of claim 1 further comprising a first section of the chamber housing which partially defines the secondary chamber; and a second section of the chamber housing which partially defines the secondary chamber and is movable relative to the first section.

10. The furnace of claim 9 further comprising a shaft which passes through the second section of the chamber housing;

wherein the second section of the chamber housing is movable relative to the shaft.

11. The furnace of claim 10 further comprising a first annular sidewall of the second section;

a flange of the second section which extends radially outwardly from the first annular sidewall;

wherein the shaft passes through the flange.

12. The furnace of claim 11 further comprising a spring adjacent the flange.

13. The furnace of claim 1 further comprising a first annular sidewall having an inner perimeter which partially defines the secondary chamber;

an annular member which is rigidly secured to the first annular sidewall, extends radially inwardly from the inner perimeter and partially defines the secondary chamber; and a ring which is vertically spaced from the annular member, partially defines the secondary chamber and is slidably received within the inner perimeter of the first annular sidewall.

14. The furnace of claim 1 further comprising a spring which engages the chamber housing.

15. The furnace of claim 1 further comprising a second compressible seal surrounding the metal casting pathway in contact with the first seal.

16. The furnace of claim 1 wherein the first seal comprises at least one of a braided ceramic material and fiberglass.

17. The furnace of claim 1 further comprising a first threaded member which is operatively connected to the chamber housing; and a second threaded member which threadedly engages the first threaded member.

18. The furnace of claim 17 further comprising a through hole formed in the chamber housing; and wherein the first threaded member extends through the hole.

* * * * *